US012152865B2

(12) United States Patent
Maurer et al.

(10) Patent No.: US 12,152,865 B2
(45) **Date of Patent: *Nov. 26, 2024**

(54) PROJECTILE AND FIREARM SYSTEM

(71) Applicant: Crossbullet, LLC, Nunnelly, TN (US)

(72) Inventors: Paul K. Maurer, Nunnelly, TN (US); Brett E. Maurer, Rochester, NY (US); Todd F. Maurer, Franklin, TN (US); Paul Della Torre, Nunnelly, TN (US); Robert Tuchrelo, Williamson, NY (US); Nathan E. Smith, Hamlin, NY (US); Richard T. Aab, Fairport, NY (US)

(73) Assignee: Crossbullet, LLC, Nunnelly, TN (US)

( * ) Notice: Subject to any disclaimer, the term of this patent is extended or adjusted under 35 U.S.C. 154(b) by 88 days.

This patent is subject to a terminal disclaimer.

(21) Appl. No.: 17/967,597

(22) Filed: Oct. 17, 2022

(65) Prior Publication Data

US 2023/0044162 A1 Feb. 9, 2023

Related U.S. Application Data

(63) Continuation-in-part of application No. 17/743,106, filed on May 12, 2022.

(60) Provisional application No. 63/187,667, filed on May 12, 2021.

(51) Int. Cl.
*F42B 10/06* (2006.01)
*F42B 5/02* (2006.01)

(52) U.S. Cl.
CPC ..... *F42B 10/06* (2013.01); *F42B 5/025* (2013.01)

(58) Field of Classification Search
CPC ..... F42B 10/06; F42B 5/067
See application file for complete search history.

(56) References Cited

U.S. PATENT DOCUMENTS

| | | | | |
|---|---|---|---|---|
| 2,045,833 A | | 6/1936 | Childs | |
| 3,151,412 A | | 10/1964 | Swindle | |
| 3,292,879 A | | 12/1966 | Saxton | |
| 3,516,326 A | * | 6/1970 | Donner | F41A 21/18 89/14.05 |

(Continued)

FOREIGN PATENT DOCUMENTS

| | | |
|---|---|---|
| FR | 493507 A | 8/1919 |
| FR | 1297569 A | 6/1962 |

(Continued)

OTHER PUBLICATIONS

DeSousa, Luis (2010) "Developments in Short Range Training Ammunition" General Dynamics Ordnance and Tactical Systems—Canada Inc., 1-22.

(Continued)

*Primary Examiner* — Justin M Benedik
(74) *Attorney, Agent, or Firm* — Harter Secrest & Emery LLP; Brian B. Shaw, Esq.

(57) ABSTRACT

A cartridge is disclosed with a casing and a projectile, wherein external ballistic stability is provided by a center of pressure of the projectile being rearward of a center of mass of the projectile. The projectile includes flight control surfaces that cooperate with the bore of a barrel without requiring rifling or sabots. The projectile can include fin configurations that cooperate with the bore to form a bearing surface with the bore.

20 Claims, 25 Drawing Sheets

(56) References Cited

U.S. PATENT DOCUMENTS

| | | | | |
|---|---|---|---|---|
| 3,566,528 | A | 3/1971 | Musser | |
| 3,690,595 | A * | 9/1972 | Rusbach | F42B 10/14 102/348 |
| 3,756,539 | A * | 9/1973 | Donner | F42B 10/06 244/91 |
| 3,759,184 | A | 9/1973 | Blajda | |
| 3,897,729 | A | 8/1975 | Schirneker | |
| 4,077,147 | A | 3/1978 | Donnard | |
| 4,524,695 | A | 6/1985 | Bisping et al. | |
| 4,829,904 | A | 5/1989 | Sullivan | |
| 5,400,716 | A | 3/1995 | Mayer | |
| 5,686,693 | A | 11/1997 | Jakobsson | |
| 8,291,828 | B2 | 10/2012 | Glasser | |
| 8,735,789 | B1 | 5/2014 | Malejko et al. | |
| 9,581,402 | B2 | 2/2017 | Minnicino, II | |
| 9,644,929 | B1 | 5/2017 | Bradbury et al. | |
| 10,352,669 | B2 | 7/2019 | Fournier et al. | |
| 11,353,302 | B1 | 6/2022 | Steffner | |
| 11,408,717 | B2 | 8/2022 | Robbins et al. | |
| 2020/0309491 | A1 | 10/2020 | Berger | |

FOREIGN PATENT DOCUMENTS

| | | | |
|---|---|---|---|
| GB | 128517 | A | 5/1919 |
| GB | 742841 | A | 1/1956 |
| RU | 2064643 | C1 | 7/1996 |

OTHER PUBLICATIONS

Pike, J. (2000) "Big Bullets for Beginners" http://www.fas.org/man/dod-101/sys/land/bullets2.htm, 1-13.

United States Patent & Trademark Office (ISA/EP), International Search Report in PCT/US2022/029011, dated Aug. 11, 2022, 4 pages.

* cited by examiner

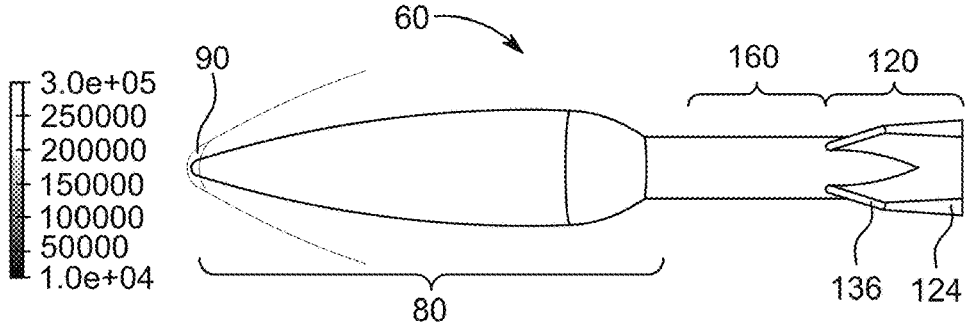
FIG. 19
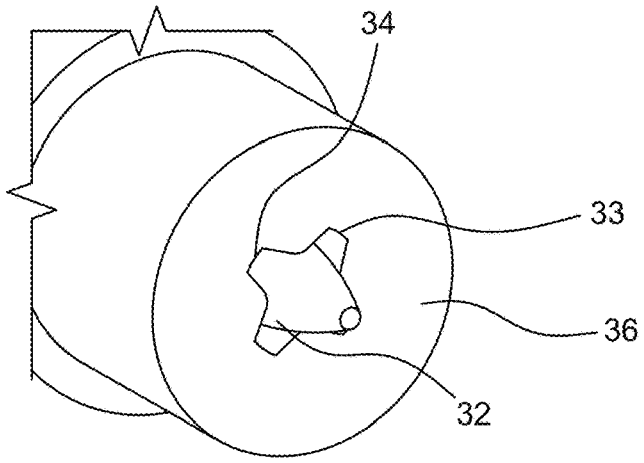
FIG. 20
Fig. 21
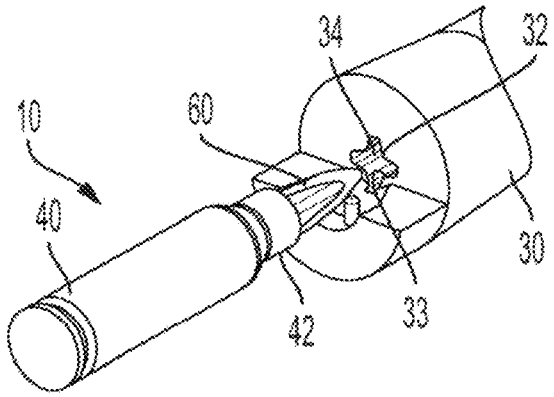
Fig. 22
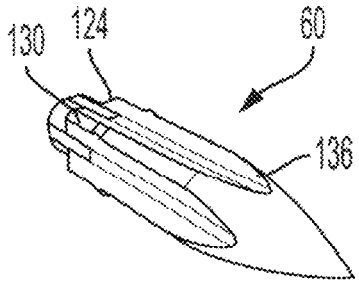

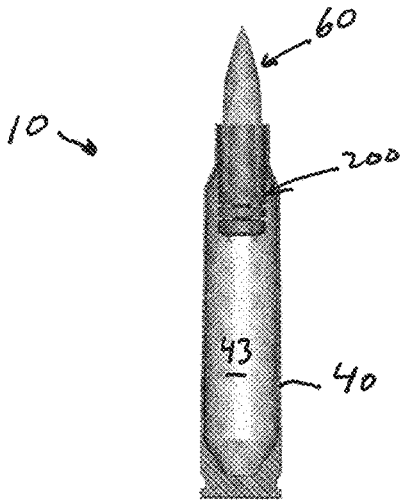
Fig. 23
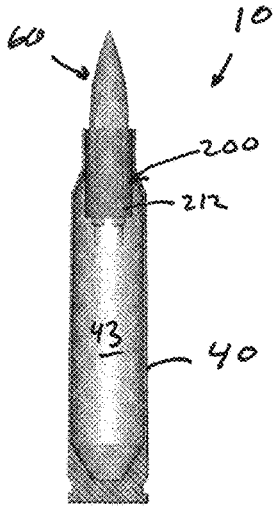
Fig. 24
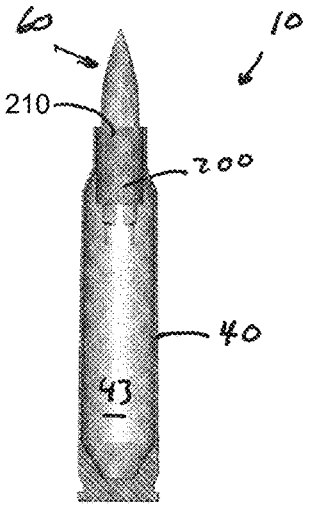
Fig. 25
Fig. 26
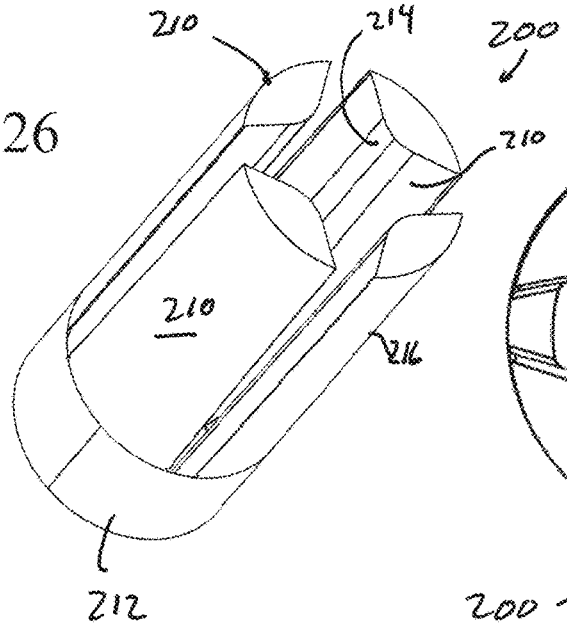
Fig. 27
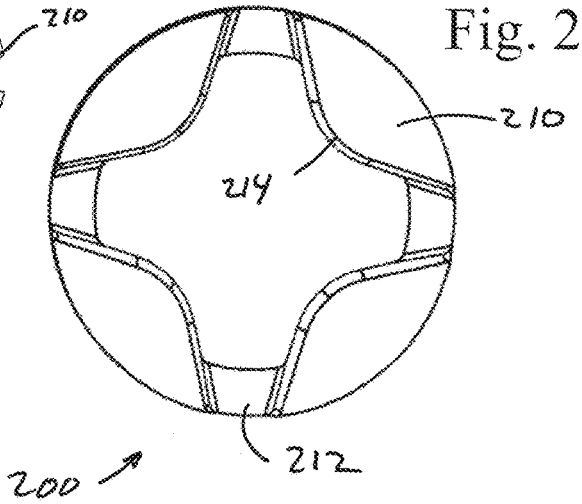

Fig. 32
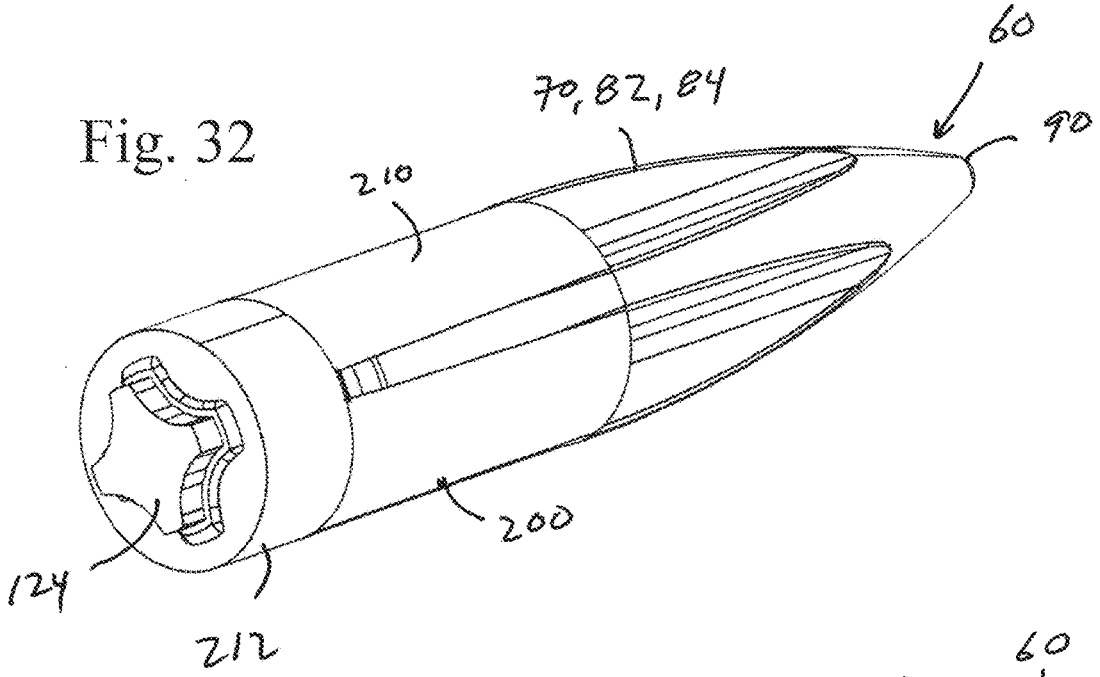
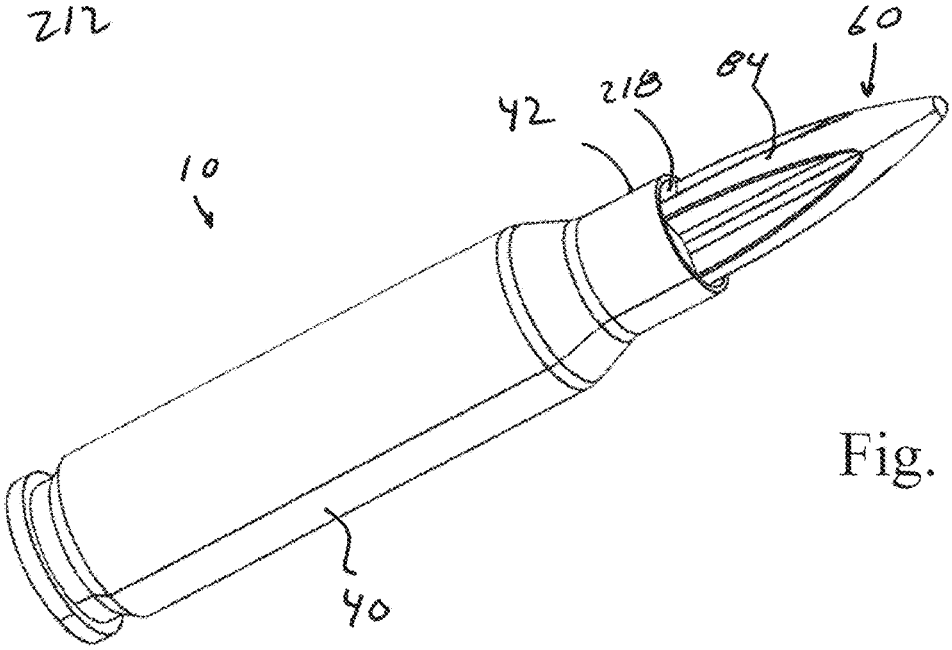
Fig. 33

Fig. 37
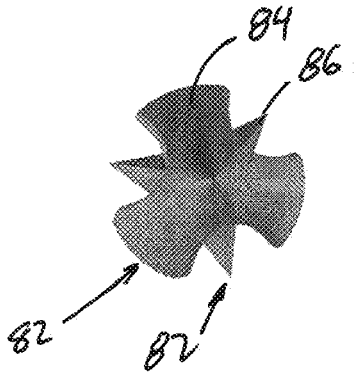
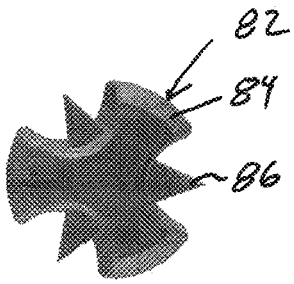
Fig. 38
Fig. 39
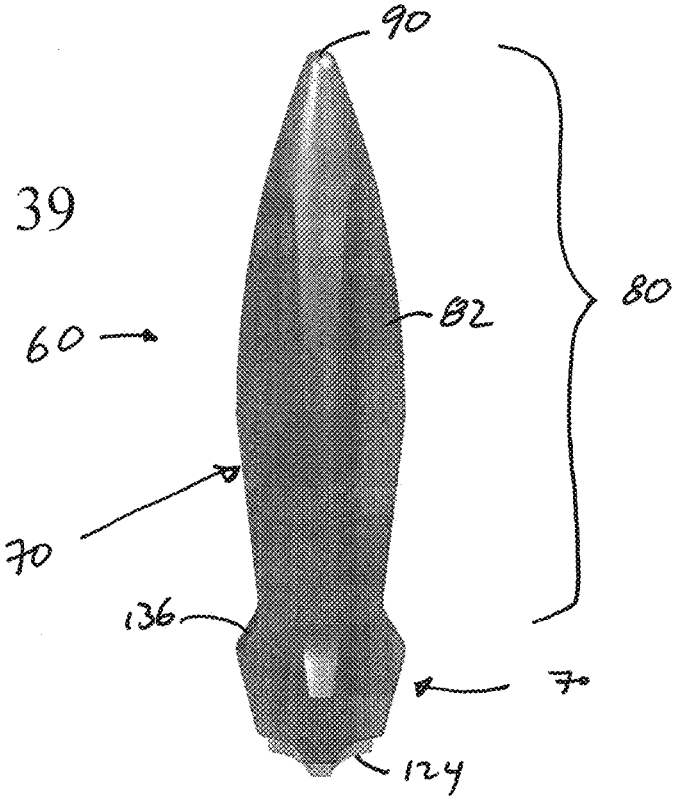
Fig. 40
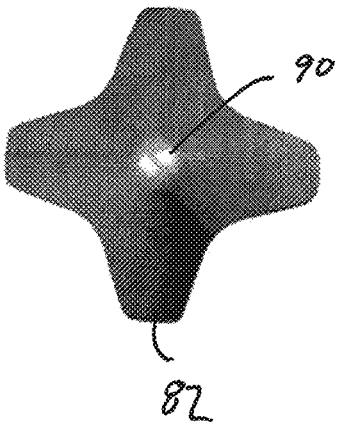
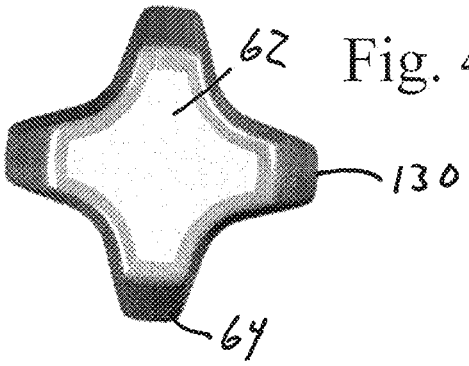
Fig. 41

Fig. 44
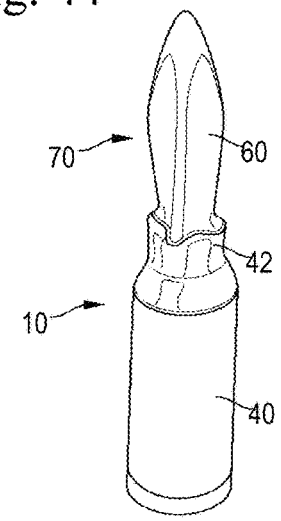
Fig. 45
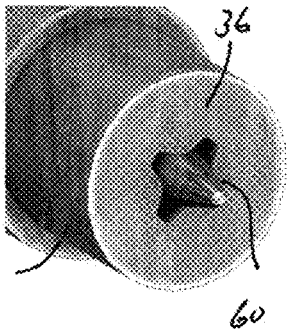
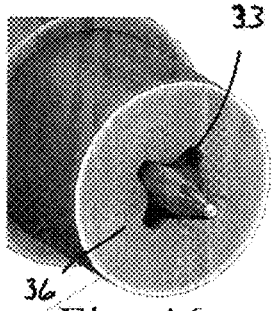
Fig. 46
Fig. 47
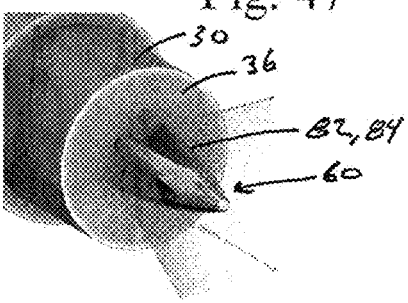
Fig. 48
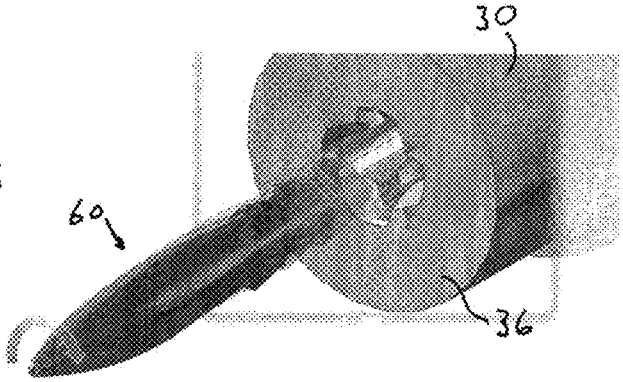

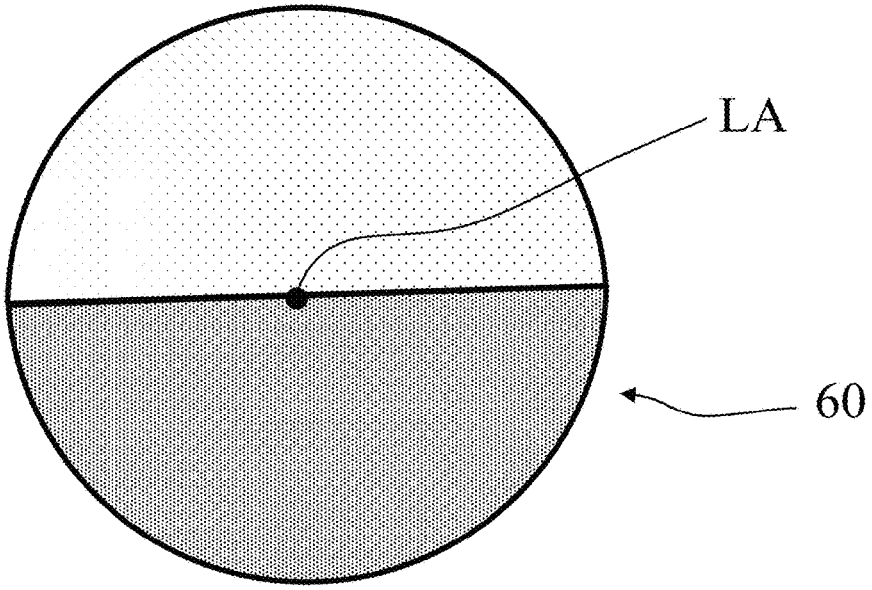
Fig. 55
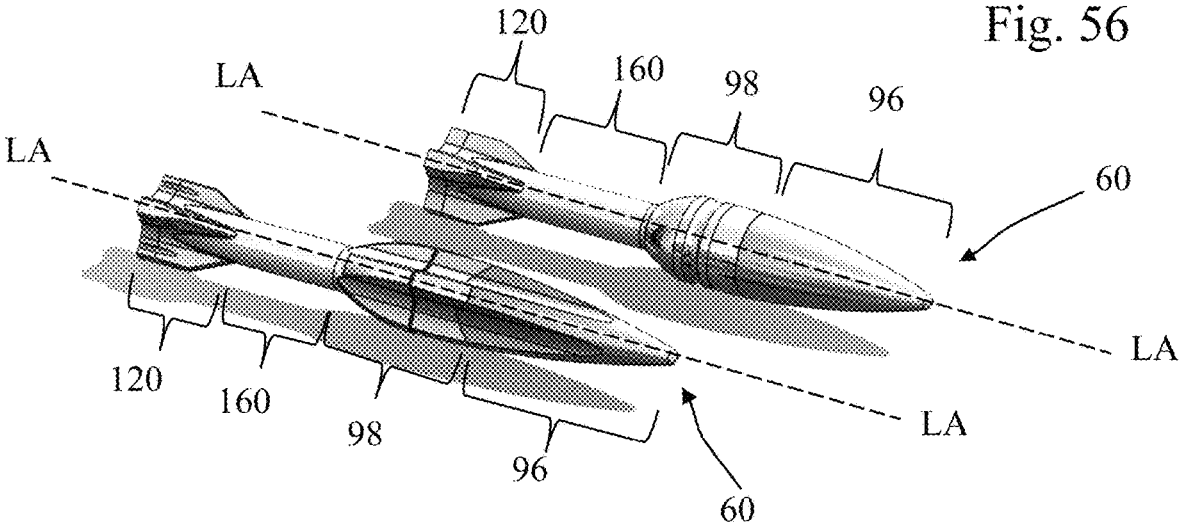
Fig. 56
Fig. 57

Fig. 70
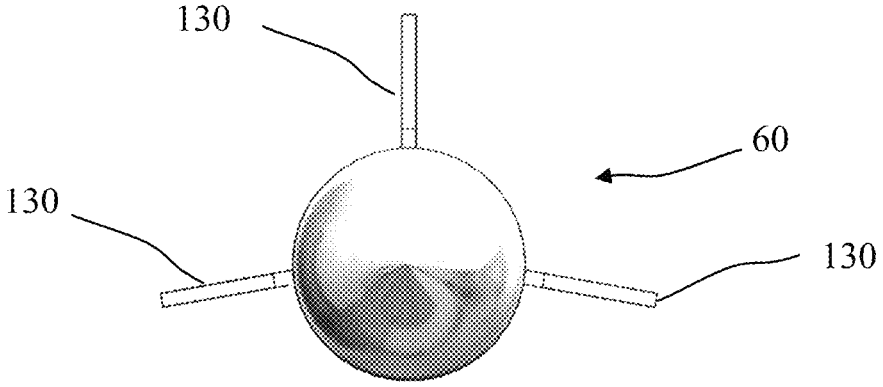
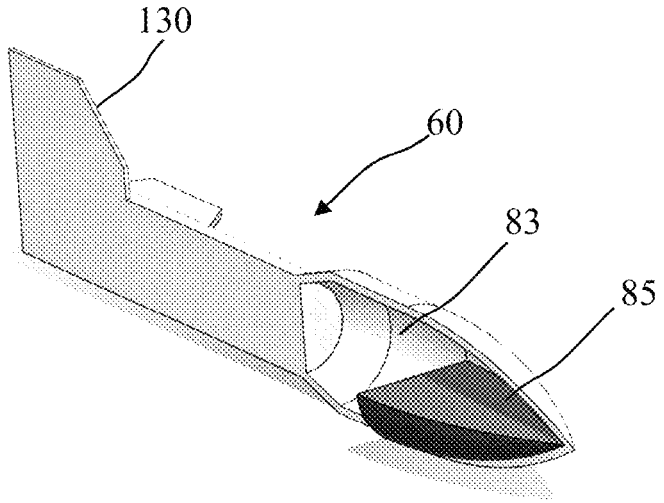
Fig. 71

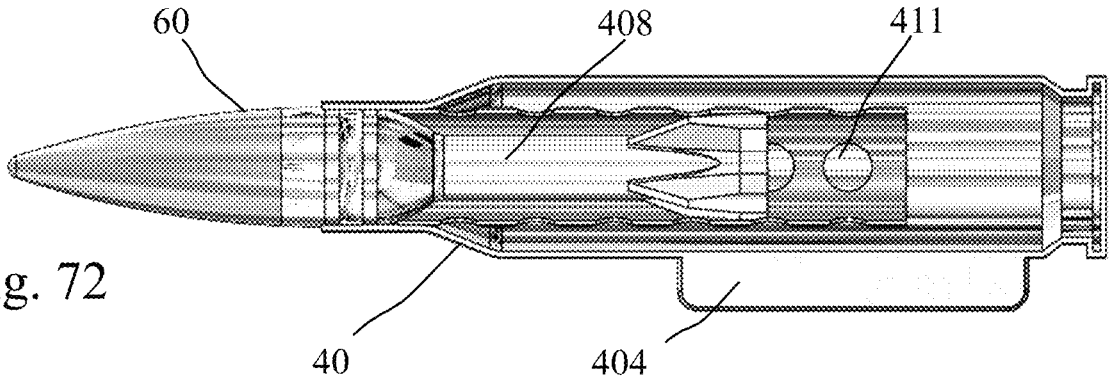
Fig. 72
Fig. 73
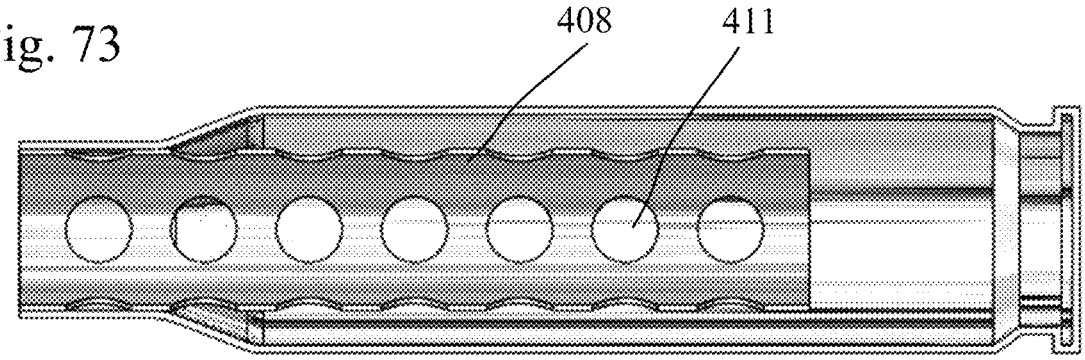
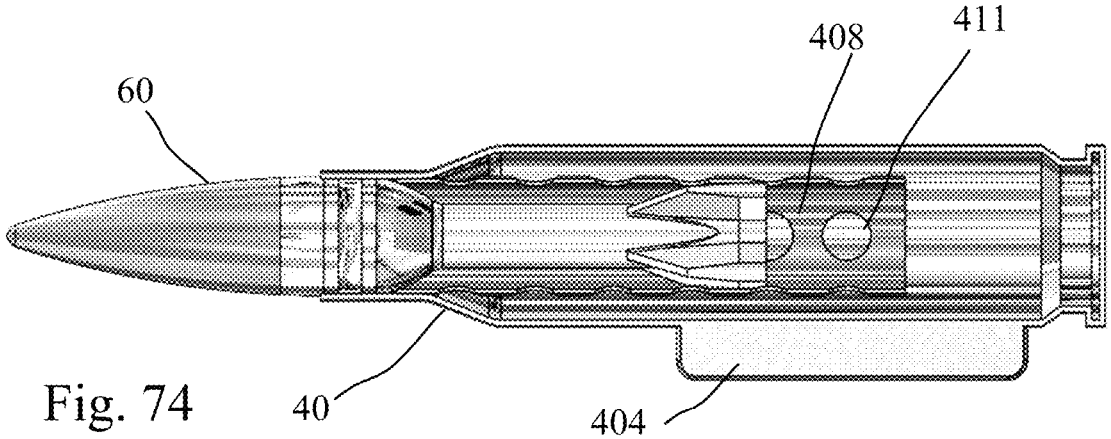
Fig. 74

Fig. 76
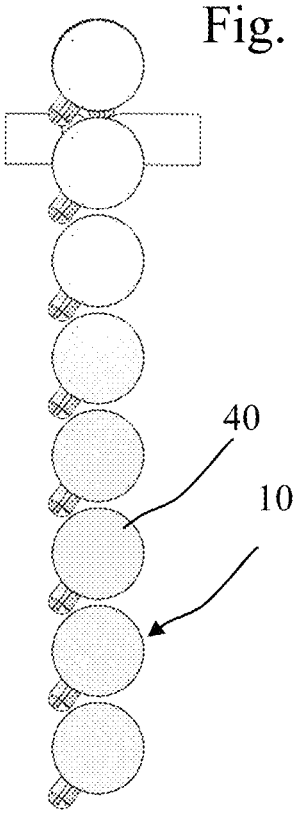
Fig. 77
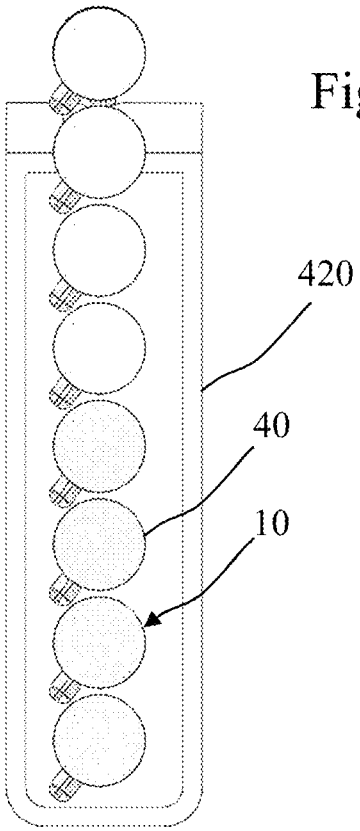
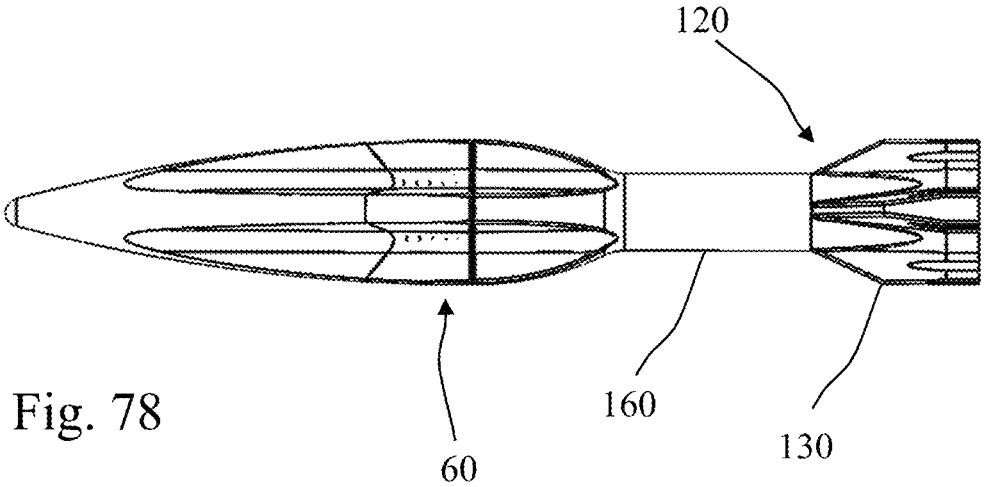
Fig. 78

Fig. 79
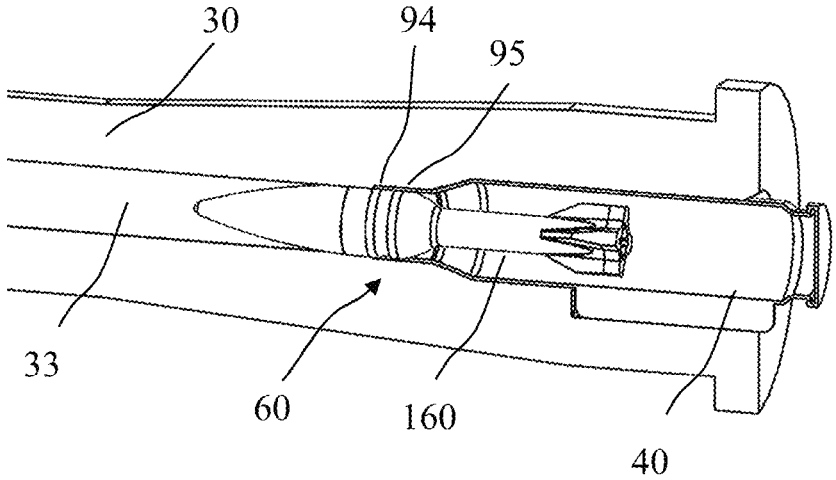
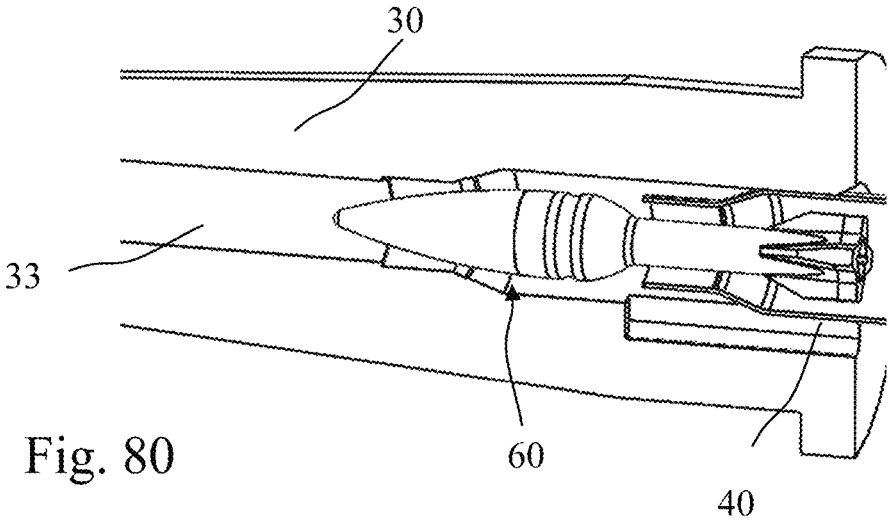
Fig. 80

PROJECTILE AND FIREARM SYSTEM

CROSS-REFERENCE TO RELATED APPLICATIONS

The present application claims the benefit of U.S. provisional patent application 63/187,667 filed May 12, 2021 and entitled PROJECTILE AND FIREARM SYSTEM, and U.S. patent application Ser. No. 17/743,106 filed May 12, 2022, the entirety of each of which is hereby expressly incorporated by reference.

BACKGROUND OF THE INVENTION

Field of the Invention

Generally, the present disclosure relates to firearms and cartridges for discharge with the firearm, and more particularly to cartridges having a projectile that includes a flight control surface, and more particularly to projectiles that do not require rotation about a longitudinal axis for external ballistic flight stability, that is free of rifling, and even more particularly to a projectile that does not require a rifled barrel or a sabot to exhibit external ballistic flight stability.

Description of Related Art

Conventional projectiles, such as bullets, typically comprise a smooth uniform shank or body portion and an axially-symmetrical front or nose portion. Bullet performance is traditionally assessed with respect to parameters including velocity, ballistic coefficient (BC), trajectory, accuracy, and target penetration. Conventional bullets, after leaving the barrel and once under unpowered free-flight, substantially degrade in flight characteristics. For example, conventional bullets begin to wobble during flight, thereby losing accuracy and velocity. Upon striking a target, such reduced velocity and wobbling limits target penetration.

Current small arms ammunition development remains rooted to a basic set of core methodologies that permits only minimal incremental benefits inside a small window of available adjustment and advantages. The use of rifled barrels allows the projectile to be stabilized, but has material limitations due to the physical properties of the process. For example, a portion of the energy utilized to force the projectile out of the cartridge and down the barrel is lost as that energy leaves the barrel ahead of the projectile passing the object via the open space in the rifling grooves.

Various efforts have been made to improve spin stabilized projectile performance and/or enable additional projectile features. For example, U.S. Pat. No. 4,829,904 to Sullivan ("Sullivan") issued May 16, 1989, discloses a substantially full bore diameter bullet that has a plurality of elongated grooves either helically formed or parallel with the longitudinal axis of the bullet and a sabot, which has a body and fingers that engage with the grooves and seal the bullet in a casing. The sabot is configured with a slightly larger diameter than the bullet such that the sabot is engraved by the rifling slots in the barrel through which the round is fired, imparting a rotation to the bullet. In alternative embodiments the grooves contain elongated elements or a plurality of spherical elements to prevent the conically tapered slug or bullet from tilting or cocking in the barrel after firing. However, the use of sabots can negatively impact the external ballistics of the bullet as the sabot disengages from the bullet.

Therefore, the need remains for projectiles that do not require either rifling or sabots to provide repeatable and accurate external ballistic flight stability.

BRIEF SUMMARY OF THE DISCLOSURE

The present disclosure provides for a sabot-free projectile for passing through a bore of a barrel, the bore having a bore caliber, the projectile including an elongate body portion extending along a longitudinal axis, the elongate body portion having a transverse dimension configured to engage the bore; a tail portion defining a rear end of the projectile and including a plurality of radially extending tail fins, the radially extending tail fins having a leading edge longitudinally intermediate the elongate body portion and the rear end of the projectile; and a stem connecting the elongate body portion and the tail portion, wherein the stem has a stem diameter less than the body diameter; wherein the body portion, the tail portion, and the stem are colinearly disposed along a longitudinal axis and define a fixed integral assembly with a projectile center of pressure and a projectile center of mass, the projectile center of pressure being longitudinally intermediate the rear end of the projectile and the projectile center of mass; and wherein, optionally, the rear end and at least a length of the tail portion includes a cavity extending along the longitudinal axis.

In a further configuration, a sabot-free projectile is provided for passing through a bore of a barrel, the bore having a bore caliber, the projectile including an elongate body portion having a body diameter and a first density, wherein the body diameter is a caliber diameter; a tail portion defining a rear end of the projectile and including a plurality of radially extending tail fins, the radially extending tail fins having a leading edge longitudinally intermediate the body portion and the rear end of the projectile; and a stem connecting the body portion and the tail portion, wherein the stem has a stem diameter less than the body diameter; wherein the body portion, the tail portion, and the stem are colinearly disposed along a longitudinal axis and define an integral assembly with a projectile center of pressure and a projectile center of mass, the projectile center of pressure being longitudinally intermediate the rear end of the projectile and the projectile center of mass; and wherein each tail fin includes at least two of a radial taper, a longitudinal taper, and a bottom surface.

Also disclosed is a sabot-free projectile for passing through a bore of a barrel, the bore having a bore caliber, the projectile including an elongate body portion having a plurality of radially projecting body portion fins, the body portion having a transverse dimension, wherein the transverse dimension is a bore caliber; a tail portion defining a rear end of the projectile and including a plurality of radially extending tail fins, the radially extending tail fins having a leading edge longitudinally intermediate the body portion and the rear end of the projectile; and a stem connecting the body portion and the tail portion, wherein the stem has a stem diameter less than the body diameter; and wherein the body portion, the tail portion, and the stem are colinearly disposed along a longitudinal axis and define an integral assembly with a projectile center of pressure and a projectile center of mass, the projectile center of pressure being longitudinally intermediate the rear end of the projectile and the projectile center of mass.

In one configuration, the present disclosure provides a sabot-free cartridge for a firearm, wherein the cartridge includes a casing; an elongate projectile extending along a longitudinal direction, the projectile coupled to the casing to define a charge volume; and a solid propellant retained within the charge volume; wherein the projectile includes at least one radially projecting and longitudinally extending flight control surface, such as but not limited to a fin or a vane, and wherein the flight control surface extends along at least 10%, to at least 50%, to at least 75% and in some configurations at least 90% of a length of the projectile. In one configuration, the fin is longitudinally bounded by longitudinally extending grooves, wherein a maximum radius from a center line of the projectile is defined by a radius of the fin. In a further configuration, a circumscribing circle of the projectile in a plane transverse to the longitudinal dimension of the projectile is defined by the radius of the fins.

The present disclosure further provides a projectile launcher for a cartridge having a projectile coupled to a casing, the projectile having a front end and a rear end with a longitudinal axis extending from the front end to the rear end and at least one radially projecting longitudinally extending flight control surface, wherein the projectile launcher includes a barrel having an elongate bore extending along the longitudinal axis, the elongate bore having a cross sectional profile configured to accommodate the radially projecting longitudinally extending flight control surface and form a bearing surface, functioning as a gas check.

A magazine assembly is disclosed, wherein the magazine assembly includes a housing sized to retain a plurality of cartridges, each cartridge having a longitudinal axis and a projectile having a fin extending along the longitudinal axis, the housing having a presenting end and a distal end; a moveable follower disposed within the housing; and a bias member disposed intermediate the follower and the housing, the bias member configured to urge the follower towards the presenting end, wherein the follower includes a groove extending along the longitudinal axis of the cartridge, the groove sized to at least partly receive a portion of the fin of one of the plurality of cartridges. The magazine assembly is further configured to present the cartridge at the presenting end with the fin in a predetermined location.

In a further configuration, a projectile assembly for a firearm is disclosed, wherein the projectile assembly includes an elongate body having a leading surface and a trailing surface, the body including a passage extending from an upstream opening in the leading surface to a downstream opening in the trailing surface.

The disclosure further includes a cartridge having a casing, a projectile, the projectile having a radially projecting longitudinally extending flight control surface, and a cradle, wherein the cradle is disposed intermediate the projectile and the casing, and the cradle is configured to preclude passage along a barrel that is configured to guide the projectile. In one configuration, the casing and the cradle are separate elements. In a further configuration, the cradle and the casing are an integral one piece construction, wherein the casing and the cradle can be of the same or different materials.

BRIEF DESCRIPTION OF THE SEVERAL VIEWS OF THE DRAWING(S)

FIG. 19 is a rendering of pressure distribution in external ballistics of the projectile of FIG. 10.

FIG. 20 is a representative barrel with a bore corresponding to the cross section of the projectile of FIG. 1.

FIG. 21 is a perspective view of a cartridge and alignment mechanism for a bore having a corresponding cross section.

FIG. 22 is a perspective view of a further configuration of the projectile.

FIG. 23 is a partial cross-sectional view of a cartridge having a first cradle and the projectile.

FIG. 24 is a partial cross-sectional view of a cartridge having a second cradle and the projectile.

FIG. 25 is a partial cross-sectional view of a cartridge having a third cradle and the projectile.

FIG. 26 is a front perspective view of a cradle.

FIG. 27 is a front end view of the cradle of FIG. 26.

FIG. 32 is a rear perspective view of the projectile and the cradle of FIG. 31.

FIG. 33 is a perspective view of the projectile and the cradle of FIG. 31 operably coupled to a casing.

FIG. 37 is a front end view of the projectile of FIG. 36.

FIG. 38 is a rear end view of the projectile of FIG. 36.

FIG. 39 is a side view of a further configuration of the projectile.

FIG. 40 is a front end view of the projectile of FIG. 39.

FIG. 41 is a cross sectional view of the projectile of FIG. 39.

FIG. 44 is a further embodiment of a cartridge with the present projectile.

FIG. 45 is a perspective view of a projectile at the muzzle of the barrel.

FIG. 46 is a perspective view of the projectile further passing the muzzle of the barrel of FIG. 45.

FIG. 47 is a perspective view of the projectile further passing the muzzle of the barrel of FIG. 45 showing the balancing of the propelling gases.

FIG. 48 is a perspective view of the projectile in external ballistics with an imparted longitudinal rotation from the propelling gases passing bore.

FIG. 55 is a schematic of a cross sectional view of the projectile showing an asymmetric mass distribution across a cross section of the projectile.

FIG. 56 is a perspective of a configuration of the projectile having three longitudinal segments of different density material.

FIG. 57 is a perspective of a configuration of the projectile having three longitudinal segments of different density material.

FIG. 70 is a front elevational view of the projectile of FIG. 69.

FIG. 71 is a perspective view with a partial cut away showing an asymmetric weighting of the projectile to provide preferential orientation relative to gravitational forces.

FIG. 72 is a side elevational cross section of a cartridge having an alignment tab for orienting the cartridge and the projectile relative to the bore, and the casing having a guide tube.

FIG. 73 is a side elevational cross section of the casing of FIG. 72 having the alignment tab for orienting the cartridge relative to a bore, and the guide tube.

FIG. 74 is a perspective view of the casing of FIG. 73.

FIG. 76 is a rear elevational view of a plurality of cartridges for presentation to the guide surface.

FIG. 77 is a rear elevational view of the plurality of cartridges of FIG. 76 retained in a magazine.

FIG. 78 is a side elevational view of a projectile having a tail portion and tail fins rotatable relative to the stem and the body of the projectile.

FIG. 79 is a perspective view of a projectile having a circular cross section and bearing surface engaging a corresponding smooth bore.

FIG. 80 is an enlarged perspective view of a projectile having a circular cross section and bearing surface for engaging a corresponding smooth bore in relation to a corresponding casing.

DETAILED DESCRIPTION

Figure 1:
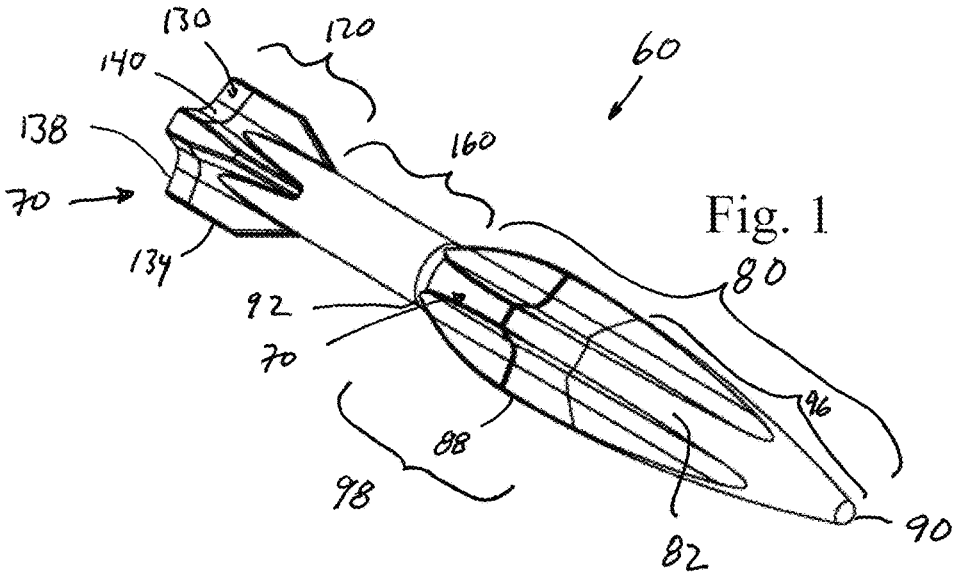
FIG. 1 is a perspective view of a first configuration of a projectile.
Figure 3:
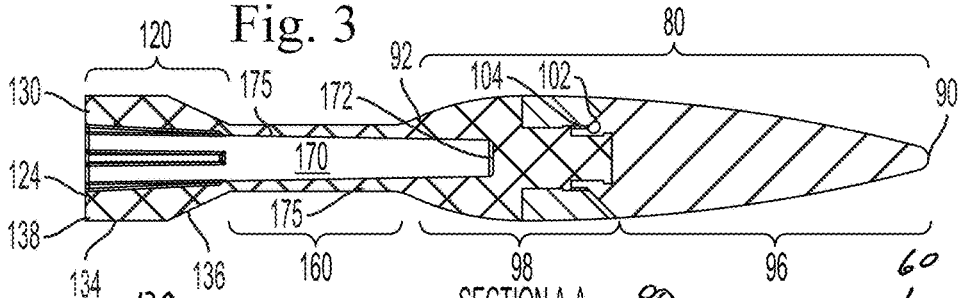
FIG. 3 is a cross sectional view taken along lines 3-3 of FIG. 2.
Figure 2:
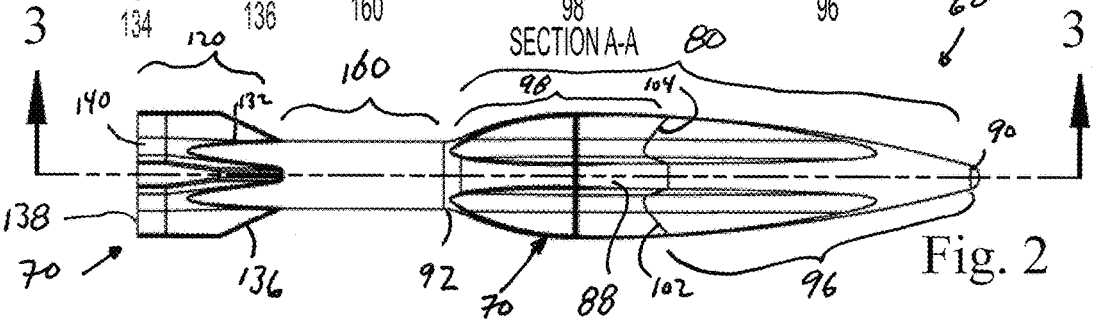
FIG. 2 is a side elevational view of the projectile of FIG. 1.

The present disclosure provides a cartridge 10 having a casing 40 and a projectile 60, wherein the cartridge cooperates with a firearm to launch the projectile through a barrel 30 of the firearm.

For purposes of the present disclosure, the term "firearm" includes an assembly of the barrel 30 and an action fixed to a stock (not shown) from which a projectile 60 is discharged such as by means of a rapidly burning propellant or combustion. The firearm is sometimes referred to as a small arm, weapon, gun, handgun, long gun, pistol, individual-service (i.e. for carry and operation by individual personnel), or revolver. The firearm can include the barrel 30 and a receiver (not shown). The receiver is the part of the firearm which integrates other components by providing a housing for internal action components such as the hammer, bolt or breechblock, firing pin and extractor. The receiver typically includes threaded interfaces for externally attaching ("receiving") components such as the barrel, the stock, the trigger mechanism and sights, including but not limited to iron/optical sights. The receiver is historically made of forged, machined, or stamped steel or aluminum. However, recent developments include receivers formed of polymers as well as sintered metal powders, such as through additive manufacturing.

The term "cartridge" 10 includes a unit of ammunition, generally including a casing (sometimes called a cartridge case), primer, powder, and the projectile 60. It is understood that the cartridge 10 is sometimes referred to a "round" or "load".

The term "projectile" 60 includes the object that is propelled by the force of gases, such as those produced by the rapidly burning propellant or combustion. For purpose of this disclosure, a bullet is a type of projectile 60.

The term "casing" 40 includes the envelope (container) of the cartridge 10, and is usually a metal cylindrical tube, normally made of brass but sometimes of steel or polymer. The casing 40 holds the projectile at a neck 42 of the casing, a propellant charge 44 is disposed within the casing, and a primer 46 is disposed in a base of the casing. The outer circumference of the base of the casing typically includes a circumferential recess and a corresponding rim to assist in extraction from the firearm after firing. The propellant charge 44 and primer 46 are any known materials in the art for launching projectiles from the casing 40.

The term "barrel" 30 includes an elongate tube, extending along a longitudinal axis, through which the projectile 60 is fired or launched. Referring, at least, to FIGS. 20 and 21, the barrel 30 includes a bore 33 having a caliber accommodating the projectile 60 to be fired, as known in the art, and extends from a breech 35 to terminate at a muzzle 36. In one configuration, the bore is a smooth bore, having in certain configurations a circular cross section and a single dimension caliber, and would accommodate the projectile of FIGS. 8-18.

The term "caliber" encompasses the cross sectional profile of the bore transverse to the longitudinal axis. Thus, the term caliber includes smooth bores, circle cross sections as well as faceted, curvilinear, or combinations thereof. Caliber also includes bores having a major cross sectional dimension and a smaller minor cross sectional dimension.

In prior systems, the barrel may include a helical rifling surface for contacting the projectile. In one configuration of the present disclosure, the present barrel 30 can include lands 32 and grooves 34, such as configured as guide surfaces for the flight control surface of the projectile 60, wherein the lands and grooves are parallel to the longitudinal axis of the barrel. In one configuration of the present disclosure, the barrel 30 includes straight cut lands and grooves. There are additional configurations of the present disclosure that can incorporate lands and grooves with either a left twist or a right twist.

For purposes of description, the term "fin" is used as a representative flight control surface and encompasses the term flight control surface. The flight control surface is any radially projecting and longitudinally extending surface of the projectile 60 that contributes to flight dynamics in at least one of the internal or external ballistics of the projectile.

Referring to FIGS. 1-9, a first configuration of the projectile 60 is shown. Generally, the projectile 60 includes an elongate body portion 80, a tail portion 120 including a plurality of radially extending tail fins 130 and defining a rear end 124 of the projectile, and a stem 160 connecting the body portion and the tail portion, wherein the stem can have a stem diameter less than a maximum diameter of the body portion or the stem can have a cross sectional profile of the caliber of the bore. In one configuration, the projectile 60 is an integral assembly, in that the projectile does not assume different profiles during external ballistics, or internal ballistics (other than propulsion induced temporary deformation). That is, in the integral assembly, the elongate body portion 80 is fixed relative to the stem 160 which has a fixed length, which in turn is fixed relative to the tail portion 120.

In the configuration of FIGS. 1-9, the body portion 80 includes a plurality of radially extending body portion fins 82. The body portion fins 82 can be formed as extending radially from the body portion 80 of the projectile 60. Alternatively, the body portion fins 82 can be formed by longitudinally extending recesses or grooves in the body portion 80 of the projectile 60. The body portion fins 82 are generally defined by a maximum diameter of the caliber of the bore 33, and can form a bearing surface acting as a gas check with the surface of the groove 34 in the bore, wherein the bore includes a cross sectional profile configured to accommodate the fins, such as the radially extending body portion fins (flight control surfaces) 82. The body portion fins 82 can define a maximum dimension of the body portion 80 and/or the projectile 60 transverse to the longitudinal axis, that is a transverse dimension. For those configurations of the body portion 80 having a circular or curvilinear cross section, the maximum transverse dimension can be a diameter, and for those configurations of the body portion having a faceted cross section, the maximum transverse dimension may be a diagonal as defined by the faceted periphery.

It is contemplated the number of body portion fins 82 can include 2, 3, 4, 5, 6, 7, or 8 fins about the circumference of the body portion 80. However, it is understood there can be a single fin 82 or more than 8 body portion fins.

The body portion fins 82 are nominally uniformly distributed about the circumference of the projectile 60. However, it is recognized the body portion fins 82 can be asymmetrically located about the circumference as well as grouped, wherein the groupings of body portion fins are symmetrically located about the circumference of the body portion 80.

Figure 36:
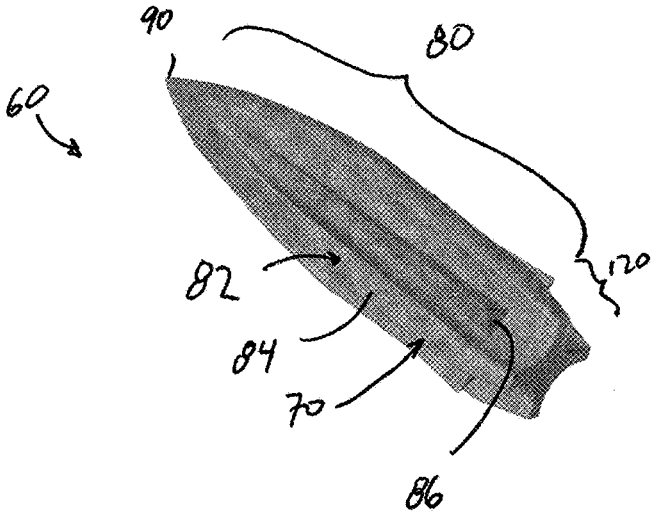
FIG. 36 is a perspective view of a further embodiment of the projectile.

As seen in FIGS. 36-38, the body portion fins 82 can include primary and secondary body portion fins 84, 86, wherein a primary body portion fin defines a maximum cross section dimension of the projectile and the secondary body portion fin has a shorter radial dimension. In those configurations of the projectile having both primary and secondary body portion fins 84, 86, the secondary fins may be longer than, shorter than, or extend the same longitudinal dimension as the primary fins. There may be more secondary body portion fins 86 than body portion primary fins 84, less secondary fins than primary fins or equal number of secondary fins and primary fins.

While the configurations shown include the primary body portion fins 84 being primary for the length of the fin, it is contemplated that a given body portion fin may have part of its length as a primary body portion fin and a second part of its length as a secondary body portion fin 86.

As seen in FIGS. 1-9, the body portion fins 82 extend along at least 25% of the length of the body portion 80 and in further configurations at least 50% of the length of the body portion and in further configurations at least 75% of the length of the body portion and in further configurations at least 85% of the length of the body portion and in further configurations at least 95% to 100% of the length of the body portion.

Figures 4, 5, 6:
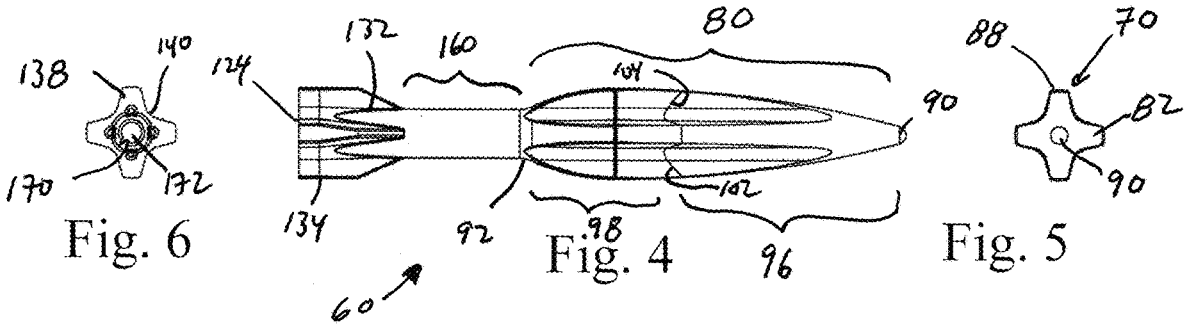
FIG. 4 is a side elevational view of the projectile of FIG. 1.
FIG. 5 is a front end view of the projectile of FIG. 4.
FIG. 6 is a rear end view of the projectile of FIG. 4.
Figure 9:
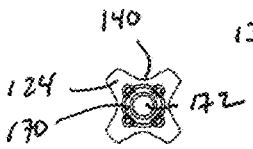
FIG. 9 is a rear end view of the projectile of FIG. 7.
Figure 7:
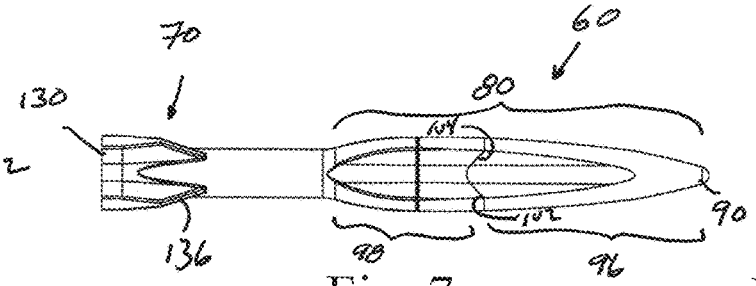
FIG. 7 is a side elevational view of the projectile of FIG. 4, rotated about a longitudinal axis by 45°.
Figure 8:
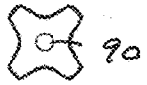
FIG. 8 is a front end view of the projectile of FIG. 7.
Figure 10:
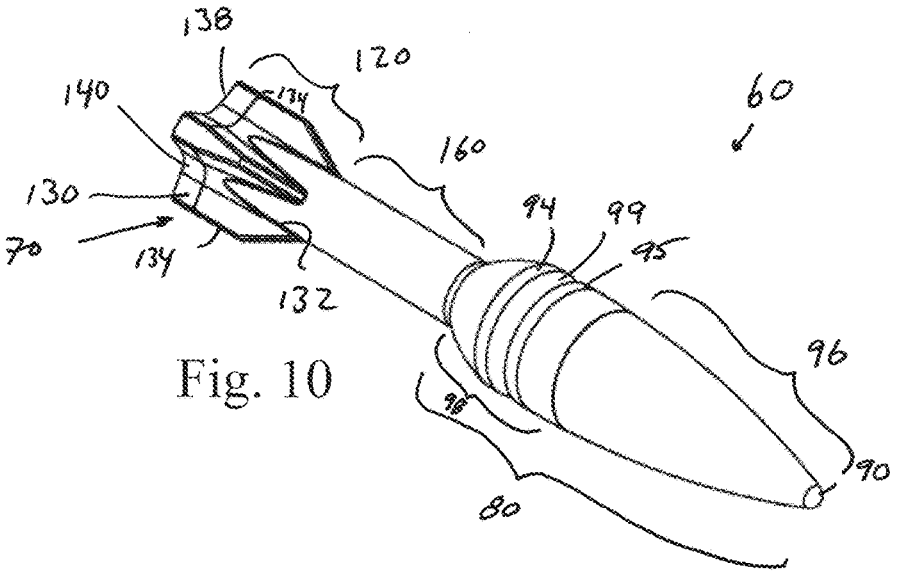
FIG. 10 is a perspective view of a second configuration of a projectile.
Figure 12:
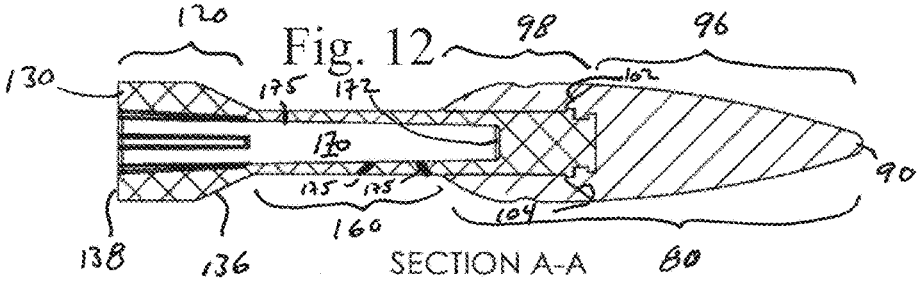
FIG. 12 is a cross sectional view taken along lines 12-12 of FIG. 11.
Figure 11:
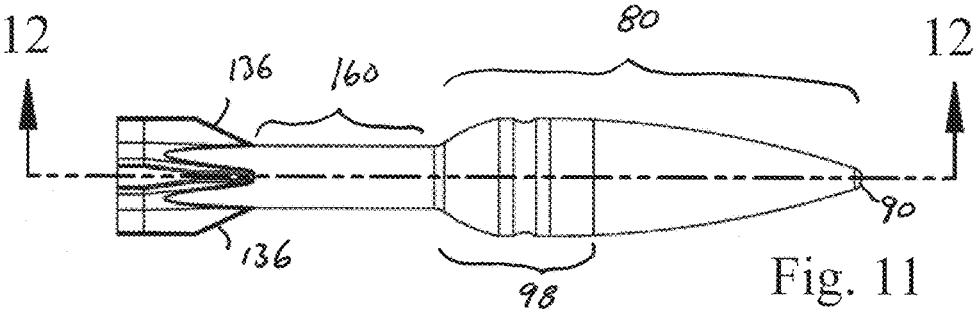
FIG. 11 is a side elevational view of the projectile of FIG. 10.
Figures 13, 14, 15:
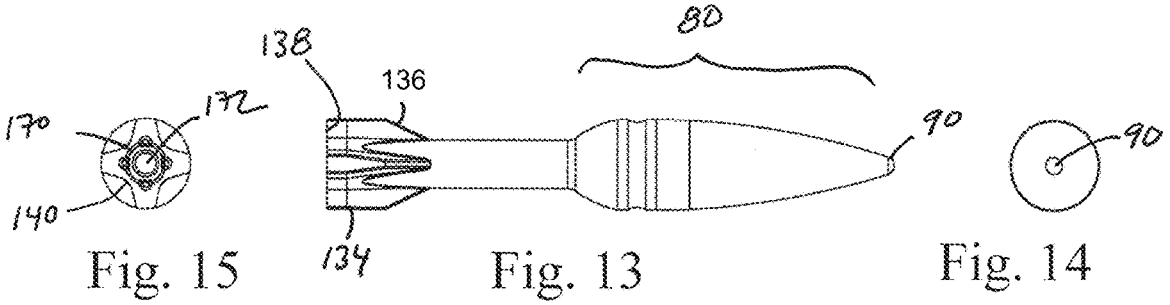
FIG. 13 is a side elevational view of the projectile of FIG. 10.
FIG. 14 is a front end view of the projectile of FIG. 13.
FIG. 15 is a rear end view of the projectile of FIG. 13.
Figures 16, 17, 18:
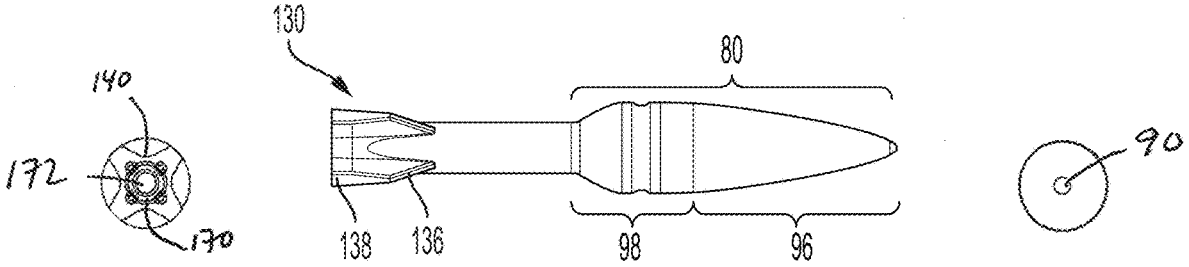
FIG. 16 is a side elevational view of the projectile of FIG. 13, rotated about a longitudinal axis by 45°.
FIG. 17 is a front end view of the projectile of FIG. 16.
FIG. 18 is a rear end view of the projectile of FIG. 16.
Figure 28:
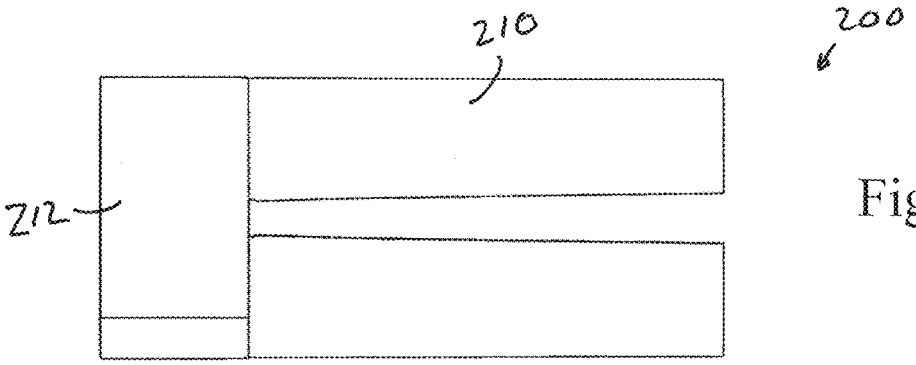
FIG. 28 is a side elevational view of the cradle of FIG. 26.
Figure 29:
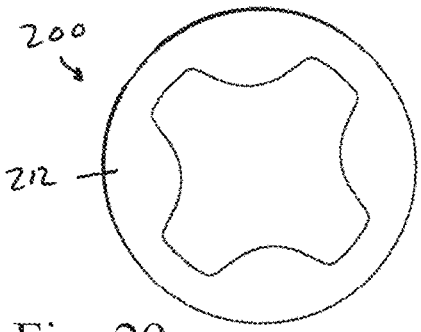
FIG. 29 is a rear end view of the cradle of FIG. 26.
Figure 30:
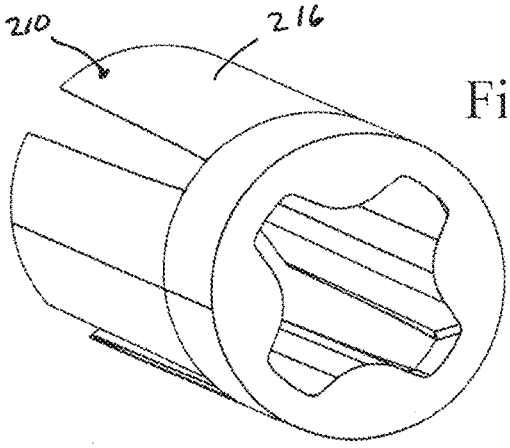
FIG. 30 is a rear perspective view of the cradle of FIG. 26.
Figure 31:
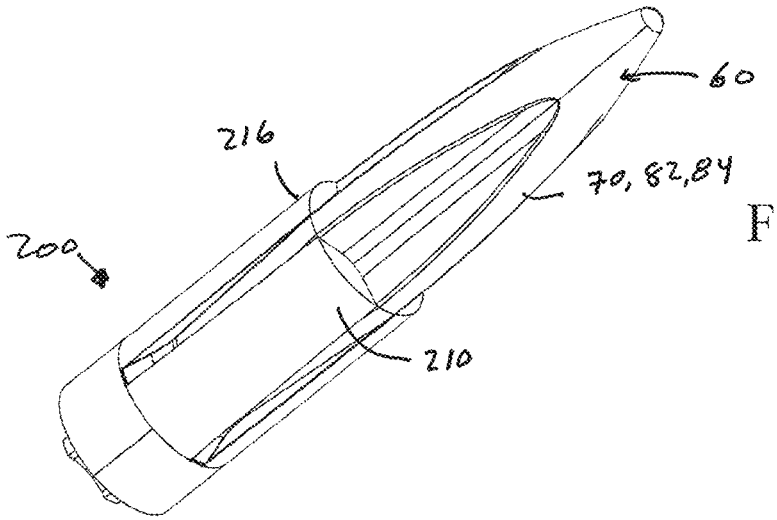
FIG. 31 is a perspective view of a projectile and a cradle.
Figure 34:
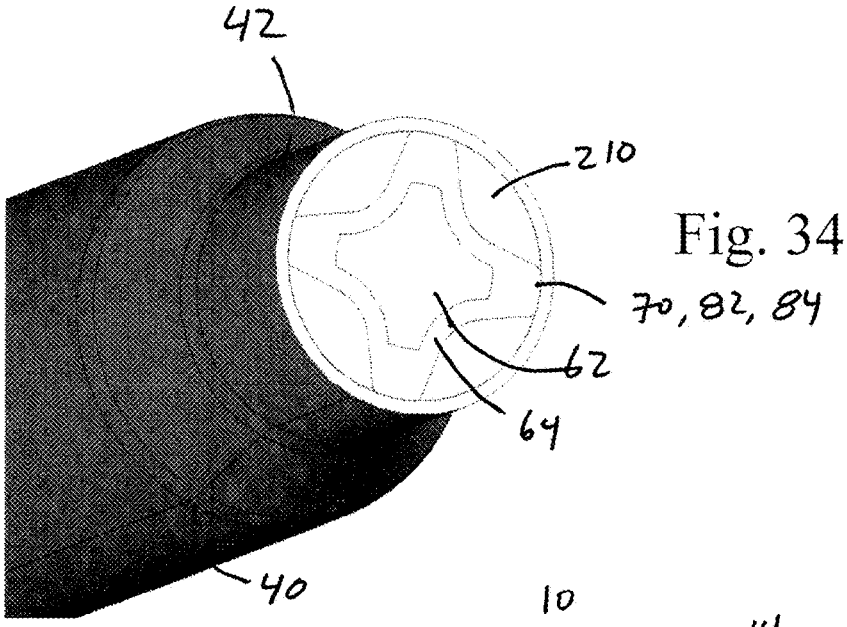
FIG. 34 is a cross sectional view of the projectile and cradle operably coupled to the casing.
Figure 35:
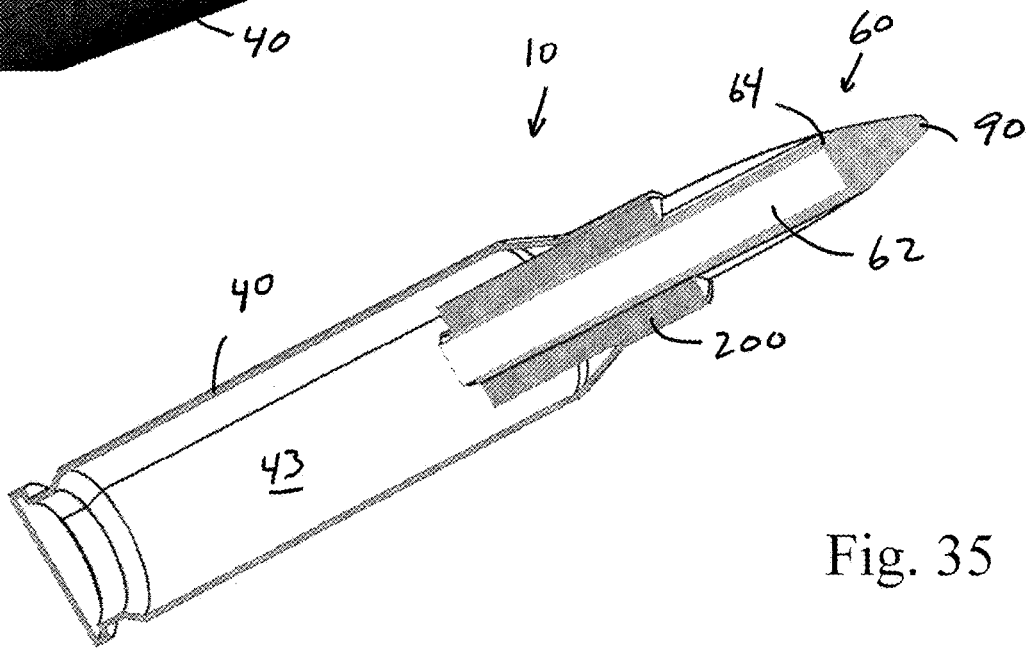
FIG. 35 is a cross sectional perspective view of a cartridge having the projectile, the cradle and the casing.

Referring to FIGS. 5 and 20, the body portion fins 82 can have a radial dimension from 5% to 75% of the diameter of the body portion. The body portion fins 82 can include a taper along a radial direction from a root to a tip 88. In one configuration, the tip 88 of the body portion fins 82 is generally curvilinear, consistent with continuous surfaced body portion, as well as the curvature of the bore 33. Though it is understood, the tip 88 can be an apex, wherein the bore 33 includes a corresponding apex. The circumferential dimension of the tips can range between 5% to 75% of the circumference of the body portion 80. In terms of the firearm 20, the firearm can thus provide a projectile launcher assembly having the barrel 30 defining the elongate bore 33 extending along the longitudinal axis, wherein the elongate bore has the cross sectional profile configured to accommodate the radially extending flight control surface 82 of the projectile 60 and form the bearing surface acting as a gas check between the projectile and the barrel.

The body portion fins 82 can be tapered along the longitudinal direction thus having an increasing circumferential dimension as the fin extends along the longitudinal dimension from a front end 90 of the body portion 80 to a rear 92 of the body portion.

The body portion fins 82 are configured to stabilize the projectile 60 in flight in the absence of rotation about the longitudinal axis of the projectile. That is, the barrel 30 and the projectile 60 are not traditionally rifled. The body portion fins 82 provide flight stabilization without requiring a rotation of the projectile 60 about the longitudinal axis.

As seen in FIGS. 20 and 45-47, the barrel 30 can include a cross sectional profile configured to accommodate a radially extending fin (or flight control surface) of the projectile 60 so as to form a bearing surface (sometimes referred to as a gas check) with a portion of the fin. That is, the bearing surface (of the bore 33, the projectile 60, or both) is configured to form a seal between the projectile and the bore to prevent propellant gas from moving through the bore past the projectile, between the projectile and the bore. As set forth below, the bearing surface can be a peripheral band or longitudinal section of the projectile 60.

Figure 51:
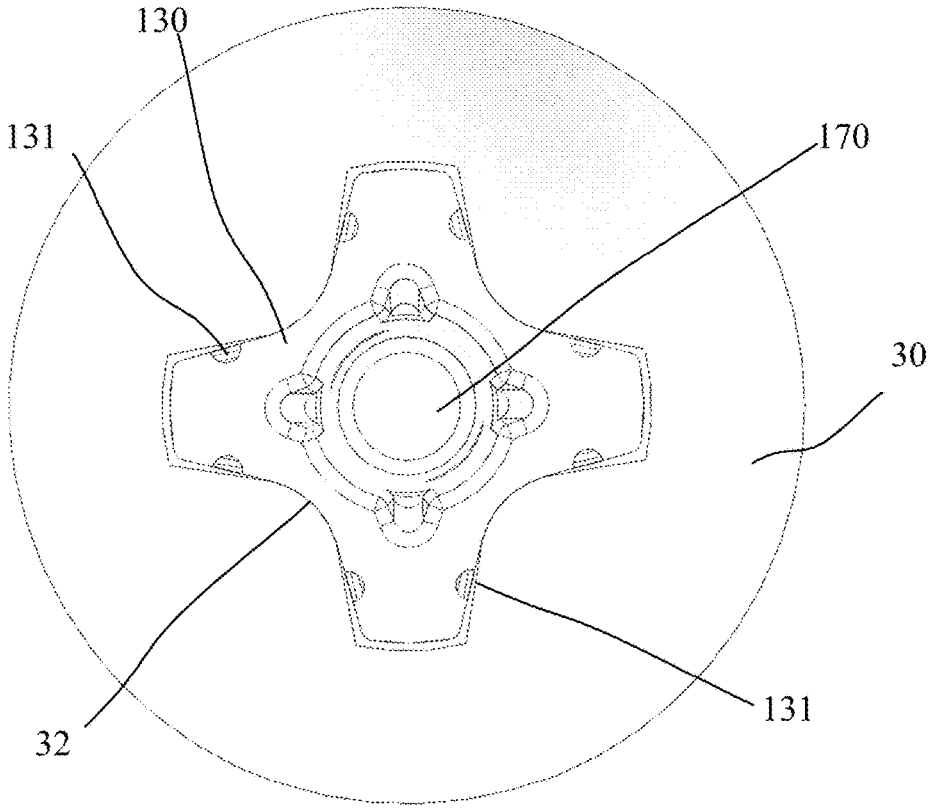
FIG. 51 is a rear end elevational view of a projectile in a bore of a barrel having bearing surfaces and bypass channels in fins.

The barrel 30 can include a plurality of radially outwardly extending grooves 34 which extend beyond the caliber of the bore 33, wherein the grooves are formed along the entire length for the bore and are parallel to the longitudinal axis of the bore. The grooves 34 are sized to slideably receive the corresponding fins 82 and/or 130 of the projectile 60, such as the body fins 82 on the body portion 80 of the projectile as well as the tail fins 130 on the tail portion 120 of the projectile 60. Further, the grooves 34 can be sized to substantially preclude shaping or deformation of the projectile 60, including the flight control surfaces 70, 82, 84, 86 during passage along the bore 33. Referring to FIGS. 20, 45-47 50, and 51, the radially inward projecting guide surfaces 32 are circumferentially intermediate adjacent grooves 34 and extend parallel to the longitudinal axis LA. The radially inward projecting guide surface 32 is configured to contact the projectile 60 as the projectile passes along the bore 33. Thus, the bore 33 can have an inner bore surface defined by the radially inward projecting guide surface 32 at a first radial spacing from the longitudinal axis and an outer bore surface defined by the grooves 34 at a greater second radial spacing from the longitudinal axis. As seen in the FIG. 50, the inner bore surface and the outer bore surface are parallel to the longitudinal axis. Thus, the elongate barrel 30 extending along the longitudinal axis LA, can include the bore 33 extending along the longitudinal axis, wherein the bore, in one configuration, includes the inner bore surface 32 and the outer bore surface 34 extending parallel to the longitudinal axis, wherein the inner bore surface defines the first radial spacing from the longitudinal axis and the outer bore surface defines the greater second radial spacing from the longitudinal axis. It is further contemplated the barrel 30 can have the bore 33 extending along the longitudinal axis, wherein the bore has a cross sectional profile including the radially inward projecting guide surface 32 extending parallel to the longitudinal axis. In select configurations, the radially inward projecting guide surface 32 has a radial dimension of at least 10% the maximum diameter of the bore. In further configurations, the radially inward projecting guide surface 32 has a radial dimension between at least 5% to 40% of the maximum diameter of the bore 33. Although the radially inward projecting guide surface 32 is shown as having a curvilinear inner apex at the minimum radial dimension configured to contact a corresponding portion of the projectile 60, it is contemplated the inner apex can be faceted, as dictated by the intended corresponding projectile 60. As seen in FIG. 51, the radially inward projecting guide surfaces 32 are curvilinear surfaces forming the bearing surface with the projectile 60 circumferentially intermediate the fins 82 or 130.

As set forth below, the projectile 60 can thus have a first cross section at a first longitudinal location and a longitudinally spaced second cross section, the first cross section configured to form a bearing surface (or gas check) with a portion of the inward projecting guide surface 32 and a second cross section configured to form a bypass passage with the bore 33.

In certain configurations, as set forth above, the closed radial end of the grooves 34 and the radially inward projecting guide surfaces 32 are configured to define a bearing surface (or gas check) with the projectile 60. As set forth below, it is contemplated one of the inner bore surface and the outer bore surface may have an increasing radial spacing from the longitudinal axis, thereby allowing propellant gas to pass along the longitudinal axis between the bore 33 and the projectile 60.

In an alternative configuration, the body portion of the projectile has a continuous surface, with a circumferential recess 99, such as shown in FIGS. 10-19 and defines at least one circumferential bearing surface 94 with the bore, to provide the gas check function of preventing passage of propellant gas. In both this configuration of the body portion 80 and the configuration of FIGS. 1-9, the body portion can include a nose section 96 including the front end (tip) 90 and a back section 98 which includes the bearing surface 94 with the bore and transitions to the stem 160. The shape of nose section 96 is typically an ogive, which reduces the coefficient of drag of the projectile 60 and increases the ballistic coefficient. Thus, the elongate body portion 80 can include the nose section 96 including an increasing taper along the longitudinal axis and the back section 98 having at least one of a decreasing taper along the longitudinal axis or a step down shoulder defining a reduction in the radial dimension.

In the configurations of FIGS. 10-19, the body portion 80 includes bearing surface 94 is a primary bearing surface and the body portion includes a secondary bearing surface longitudinally bounding the circumferential recess. The primary bearing surface 94 is rearward of the circumferential recess 99 and the secondary bearing surface 95 is forward of the circumferential recess. The bearing surfaces 94, 95 cooperate with a smooth bore barrel 30, as seen in FIGS. 79 and 80, and the primary bearing surface forms the gas check. It is contemplated the secondary bearing surface 95 can also restrict the passage of propulsion gases between the projectile 60 and the bore 33. The primary and secondary bearing surfaces being longitudinally spaced along the longitudinal axis can further provide stability (orientation maintenance) as the projectile 60 travels through the bore 33.

The nose section 96 and the back section 98 of the body portion 80 can be formed of different materials, having different densities and hardness. For example in one configuration, the nose section 96 has a greater density and is harder than the back section 98. For example, the nose section 96 can be formed of tungsten and the back section 98 formed of copper, or the core 62 as set forth below can be formed of lead. However, other material choices are available with departing from the present disclosure and preserving the relative hardness and density between the nose section 96 and the back section 98. In one configuration, the material of the nose section 96 and the shape of the section is selected to have a greater resistance to deformation than the stem 160 and the tail portion 120. A further benefit of tungsten, or a relatively hard front end 90, is a reduction in unintended deformation of the front end from incidental contact of the cartridge between manufacture and use. That is, nicks and mars on the front end 90 can negatively impact the performance of the given projectile 60, as well as decrease the consistency in round-over-round performance.

For example, representative materials of the nose section 96 and the back section 98 can include tungsten having a density of approximately 19000 kg/m$^3$: for the nose section and copper having a density of approximately 8900 kg/m$^3$, for the back section. However, it is understood that lead can be used in one of the nose section 96 and the back section 98, as well as in the configuration of a cladding. Further, the materials forming the projectile 60 can be selected to provide the surfaces that contact the bore are formed of less abrasive or detrimental to the material of the bore than the remaining materials of the projectile.

In one configuration, the projectile 60 can be constructed with at least the nose section 96 having a greater inertia than a trailing section, such as the back section 98, the stem 160, or the tail portion 120. In a further configuration, the projectile 60 includes a section of greater inertia closer to the front of the projectile than a portion of lower inertia, wherein the portion of lower inertia exhibits a greater radial deformation than the portion of greater inertia. Thus, upon exposure of the projectile 60 to the propellant gas, the propellant gases urges the projectile towards the muzzle, wherein the leading section of greater inertia resists movement along the bore more than the portion of lower inertia. Thus, the portion of lower inertia is longitudinally compressed by the propellant gas acted on the rear of the projectile and the portion of greater inertia resisting longitudinal movement of the projectile. This longitudinal compression of the portion of lower inertia can result in a radial expansion, thereby providing a bearing surface and reducing or preventing the passage of propellant gas forward of the bearing surface. For example, the nose section 96 being formed of tungsten and having a volume sufficient to be heavier than the back section 98 formed of copper can provide the projectile with the ability to radially expand the back section in response to exposure to propellant gas such that the back section contacts the bore and forms a bearing surface.

Figure 52:
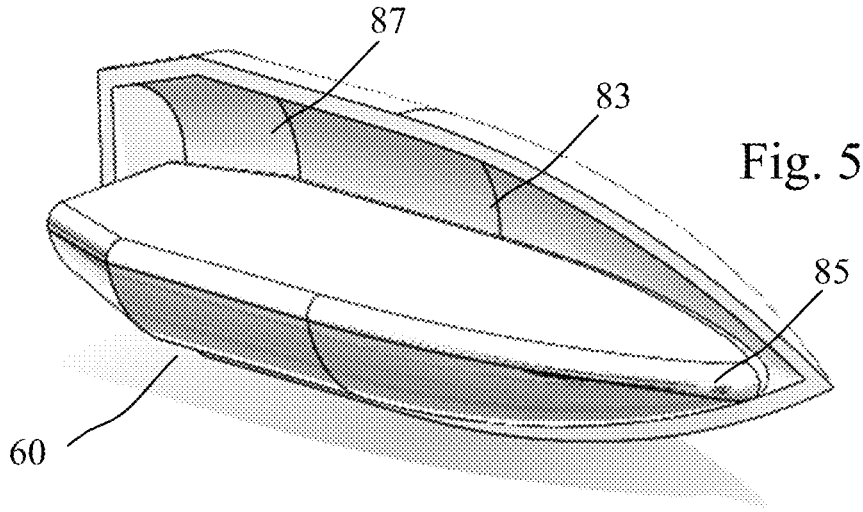
FIG. 52 is a perspective partial cut away view of a projectile having a balancing cavity and a retained liquid.

Referring to FIG. 52, the projectile 60 can be configured to provide gravity assisted stabilization or preferential gravitational orientation. For example, the body portion 80 of the projectile 60 can include a balancing cavity 83, wherein the balancing cavity retains a mass of a liquid 85, such that the liquid is sealed within the cavity. In one configuration, the balancing cavity 83 and the liquid 85 define an ullage space 87. It is also contemplated balancing cavity 83 and the retained liquid 85 can be configured to render the balancing cavity free of an ullage space. In one configuration, the liquid 85 can be denser than water, such as mercury or alloys of gallium, indium and tin which are liquid at room temperature.

Figure 53:
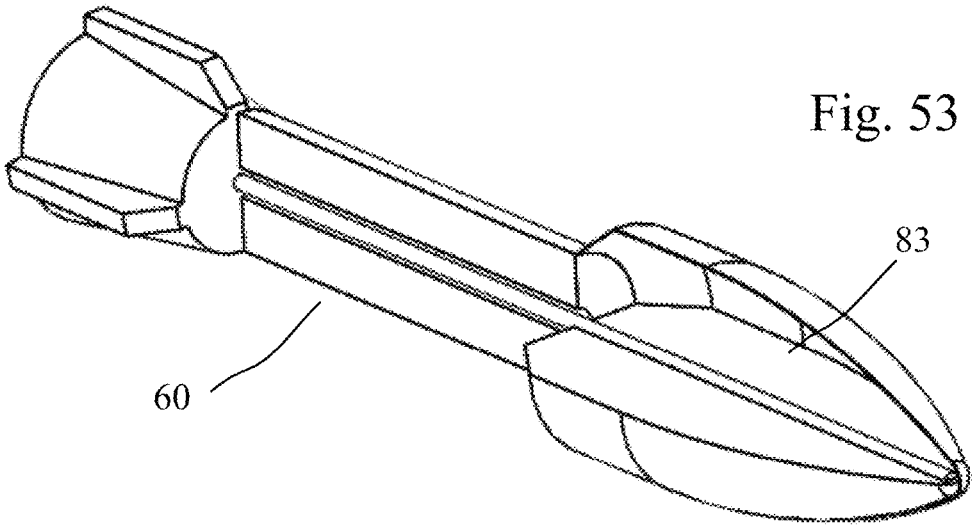
FIG. 53 is a perspective partial cut away view of a projectile having a balancing cavity and a retained balancing solid.

Alternatively, as seen in FIG. 53, the balancing of the projectile 60 to a gravitationally preferred orientation can be provided by the balancing cavity 83 retaining a solid weight disposed within the balancing cavity, wherein the solid weight is moveable between a first position within the cavity and a second position within the cavity. The weight can translate or rotate relative to an axle or pin passing through the balancing cavity 83, wherein the solid weight moves from the first position to the second position in response to gravity. Thus, in the configuration of the projectile 60 having asymmetric fins, such as for generating lift, the weight orients the projectile in a predetermined relationship to gravity and thus orients the asymmetric fins in the proper orientation for generating lift.

Figure 54:
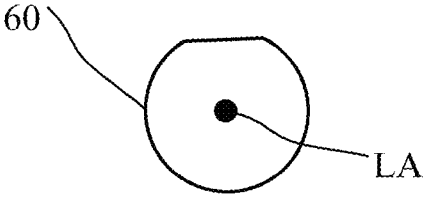
FIG. 54 is a perspective view of a projectile having an asymmetric cross section relative to the longitudinal axis.

In a further configuration, the body portion 80, includes a length of the body portion having a cross sectional area perpendicular to the longitudinal axis is asymmetric relative to the longitudinal axis, thus defining an asymmetric body portion, as seen in FIG. 54. The length of the asymmetric body portion is at least 5% of the length of the projectile 60 and in certain configurations at least 25% to 75% of the length of the projectile. However, it is understood, the length of the asymmetric body portion can be between 5% to 100% of the length of the body portion 80. The asymmetric body portion 80 is configured to impart a preferential orientation of the projectile 60 relative to gravity. Thus, the tail fins 130 can be configured to generate lift, thereby extending the flight of the projectile 60 over non-lift producing projectiles.

Referring to FIG. 55, it is further contemplated the projectile 60 can be configured to have a mass distribution that is asymmetric with respect to the longitudinal axis LA. For example, a cross sectional mass distribution perpendicular to the longitudinal axis is asymmetric relative to the longitudinal axis. For example a first half of the cross section may be a first material of a first density and a second half of the cross section may be a second material of a different second density, thereby creating an asymmetric mass distribution perpendicular to the longitudinal axis LA. The length of the asymmetric cross sectional mass distribution along the longitudinal axis is at least 5% of the length of the projectile 60 and in certain configurations at least 25% to 75% of the length of the projectile. However, it is understood, the length of the asymmetric cross sectional mass distribution along the longitudinal axis can be between 5% to 100% of the length of the projectile 60. The asymmetric cross sectional mass distribution of the projectile 60 is configured to impart a preferential orientation of the projectile relative to gravity. Thus, the tail fins 130 can be configured to generate lift, thereby extending the flight of the projectile 60 over non-lift producing projectiles.

In a further configuration, the body portion 80, includes a length having a cross sectional mass distribution perpendicular to the longitudinal axis asymmetric relative to the longitudinal axis, thus defining the asymmetric body portion, as shown schematically in FIG. 55. The length of the asymmetric cross sectional mass distribution along the longitudinal axis is at least 5% of the length of the projectile 60 and in certain configurations at least 25% to 75% of the length of the projectile. However, it is understood, the length of the asymmetric cross sectional mass distribution of the body portion can be between 5% to 100% of the length of the body portion 80. The asymmetric body portion 80 is configured to impart a preferential orientation of the projectile 60 relative to gravity. Thus, the tail fins 130 can be configured to generate lift, thereby extending the flight of the projectile 60.

The tail portion 120 of the projectile 60 defines the rear end 124 of the projectile 60 and includes the plurality of radially extending tail fins 130. As seen in FIGS. 1-19, the tail fins 130 are longitudinally spaced from the body portion 80 by the stem 160 of the projectile 60. The tail fins 130 radially extend from a root 132 to a tip 134 to define a span (the length of the fin projecting transverse to the longitudinal axis). The tail fins 130 have a leading edge 136, a sweep length, and a tip cord length. The leading edge 136 is the front surface of the fin 130. The sweep length is the longitudinal distance between the fin at the root and the tip. The tip chord length is the dimension of the tip along the longitudinal axis. In one configuration, the leading edge 136 of the tail fins 130 at the root is longitudinally spaced from the body portion 80 by a length along the stem 160 (a length along the longitudinal axis) that is at least a root chord length of the fins. That is, the stem 160 can have a greater longitudinal dimension than a root chord of the tail fins 130.

The adjacent tail fins 130 can also define a bottom surface 140 which generally presents a projected area that is transverse to the longitudinal axis. The bottom surface 140 can be configured as a circumferential extension of the root 132 of one tail fin 130 towards the root of an adjacent tail fin, or as an increase in diameter along the longitudinal axis towards the rear end of either the body of the tail portion 120 (or the stem 160). In one configuration of the bottom surface 140, the bottom surface defines a slope with respect to the longitudinal axis greater than 0° and in certain configurations of at least 10°, and in further configurations at least 20°, and in certain configurations at least 30° to 45° or more. Thus, the radial taper, the longitudinal taper, and the bottom surface can be configured to increase a pressure acting on the surfaces. While it is contemplated the tail fins 130 can include each of the radial taper, the longitudinal taper, and the bottom surface, there are configurations of the tail fins employing just one of the radial taper, the longitudinal taper, and the bottom surface, or employing at least two of the radial taper, the longitudinal taper, and the bottom surface. In one configuration, each tail fin 130 includes at least one of, at least two of, or each of a radial taper, a longitudinal taper, and the bottom surface 140. In a further configuration, the cumulative projected area of the tail fins 130 is between 20% of the cross sectional area of the stem and 2,000% of the cross sectional area of the stem 160, wherein the cross sectional area of the stem is taken as including the cross sectional area encompassed by the circumference of the stem. That is, a hollow stem is treated as a solid stem in calculating the cross sectional area.

In an alternative configuration, seen in FIG. 78, at least the tail fins 130, and/or the tail portion 120 can be rotatable relative to the body portion 80. In this configuration, the tail fins can rotate about the longitudinal axis. It is contemplated the tail fins 130 can include a socket or port to interface with a longitudinally extending axle, or the tail fins can include a longitudinally extending axle that cooperates with a socket or port of the stem 160 or body portion.

In a further configuration, the span of the tail fins 130 is at least 10% of the caliber of the bore 33. In one configuration, each tail fin 130 has a span between 10% and 75% of the bore caliber. In another configuration, the span of the tail fin 130 is at least 25% the diameter of the stem. It is contemplated the tail fins 130 can be effectively defined by grooves formed in the stem 160, or the body of the tail portion 120, thus the tail fin could be defined by a negative diameter of the tail portion, or even the stem 160. Therefore, the span of the tail fin 130 can be between −50% to 600% of the diameter of the stem 160, or a cylindrical length of the tail portion 120. It is contemplated the tail fins 130 can have a cross sectional profile matching the caliber of the bore, such that the tail fins form the bearing surface with the bore, thereby providing the gas check. Thus, the tail fins 130, and particularly the rear end of the tail fins can define the surface of the projectile 60 that is exposed to the motive vector of the propellant gas.

As seen in the FIGS. 1, 2, 4, 7, 10, 12, 15, 16, and 19, the tail fins 130 can include a radial taper from the root 132 to the tip 134, wherein the root has a larger circumferential dimension than the leading edge 136 or the tip. The radial taper from the root 132 to the tip 134 can be from between 1.1:1 to 5:1. In addition, the tail fins 130 can have a longitudinal taper, wherein the leading edge 136 of the tail fins has a smaller circumferential dimension than a trialing edge 138 of the tail fins. The longitudinal taper from the leading edge 136 of the tail fin 130 to the trailing edge 138 of the tail fin can be from between 1:1.1 to 1:6. By adjusting the surface area of the leading edge 136 (either by adjusting the area of individual leading edges and/or number of leading edges) along with adjusting the radial taper and the longitudinal taper, the tail fins 130 can generate sufficient pressure (and hence force) during external ballistics (flight) of the projectile 60 to generate the center of pressure of the projectile rearward of the center of mass of the projectile, wherein the center of mass of the projectile can be adjusted by the materials (density) of the components of the tail portion 120, the body portion 80, and the stem 160 as well as the relative sizing of the nose section 96 and the back section 98 in the body portion.

In one configuration, the tail portion 120, including the tail fins 130 generate sufficient pressure on the projectile 60 so that the center of pressure of the projectile and the center of mass of the projectile create at least a positive stability margin, and in certain configurations at least a 5% stability margin, and in further configurations at least a 10% stability margin, where the stability margin is defined as (Center of Massx-Center of Pressurex)/(Overall projectile length)*100, and is dependent on the angle of attack, velocity, etc. In certain configurations, the stability margin is between 0% and 45%. The present calculations are done at a 5° angle of attack. In certain configurations, it is believed the stability margin can increase as the angle of attack decreases from 5° towards 0°. It is further contemplated the stability margin, in view of the angle of attack, can be selected such that the projectile 60 is effectively self stabilizing during external ballistics.

Although the tail fins 130 are shown as extending along the longitudinal direction between 15% to 20% of the total length of the projectile 60, it is understood the tail fins can extend along the longitudinal dimension from 0% to 60%, or up to 100% of the total length of the projectile. In one configuration, the number of body portion fins 82 equals the number of tail fins 130, and in a further configuration, the body portion fins are longitudinally aligned with the tail fins, as seen in FIGS. 1-9. However, it is understood that the body portion fins 82 and the tail fins 130 can be longitudinally offset. It is further understood that the number of body portion fins 82 and the number of tail fins 130 can be unequal, wherein the number of tails fins is greater than or less than the number of body portion fins. In a further configuration, the body portion fins 82 and the tail fins 130 can be coextensive, thereby defining a continuous fin along the longitudinal axis. Conversely, there can be a gap longitudinally separating the body portion fins from the tail fins 130. It is further contemplated that the stem 160 can include longitudinally reinforcing ribs which project from an outer surface of the stem, wherein the reinforcing ribs are collinear with one or both of the body portion fins 82 and the tail fins 130. However, the reinforcing ribs do not materially contribute to the location of the center of pressure of the projectile 60.

In one configuration, the tail fins 130 can have a span to render the tail fins subcaliber. In a further configuration, the tail fins 130 can be sized to be adjacent the wall of the bore 33, thereby provide in a guiding function. It is further contemplated the radial dimension of the tail fins 130 can be selected to dispose the tip 134 of the tail fins within longitudinal grooves 34 of the barrel 30. In the sizing of the tail fins 130 to locate a portion of the tail fin within the grooves 34 of the barrel 30, the tip 134 of the tail fins can be gapped from contact of the tip with the bore, thereby providing incidental guidance, without imparting material drag. Alternatively, the tail fins 130 can be sized to ride along the bore, such as in the configuration of the smooth bore, having a circular caliber, thereby providing longitudinal stability of the projectile 60 during the internal ballistics of the projectile.

In the configuration of the body portion 80 having the body portion fins 82 (as seen in FIGS. 1-9) and the configuration of the body portion having the circumferential recess 99 with the bearing surface 94 (as seen in FIGS. 10-19), the nose section 96 and the back section 98 can be formed of different materials. The nose section 96 and the back section 98 interface at a rear face 102 of the nose section and a front face 104 of the back section. It is contemplated the rear face 102 of the nose section 96 is not perpendicular to the longitudinal axis, and the front face 104 of the back section 98 has a correspondingly incline relative to the longitudinal axis. As set forth below, upon impact of the projectile 60 with the target, the momentum of the back section 98 and the incline of the interface causes the material of the back section to separate from the remainder of the projectile and transfer its energy to the target.

In addition to the nose section 96 and the back section 98 of the body portion 80 being formed of different materials, the stem 160 and the tail portion 120 can also be formed of separate materials. As set forth below in the manufacture of the projectile 60, the portions of the projectile can be separately formed and assembled to form the projectile.

By controlling the density and hence mass of longitudinal segments of the projectile 60, the center of mass can be controlled relative to the center of pressure of the projectile, thereby providing for external ballistic stability of the projectile. For example, as seen in FIGS. 56 and 57, the projectile 60 can include at least a first longitudinal segment, or band, a second longitudinal segment, or band, and a third longitudinal segment, or band. In certain configurations, at least 50% of a cross sectional area within the first longitudinal segment comprises a first material, wherein at least 50% of a cross sectional area within the second longitudinal segment comprises a second material, and at least 50% of a cross sectional area within the third longitudinal segment comprises a third material. In further configurations, the material of the respective first segment, the second segment, and the third segment are homogeneous. It is also contemplated that the respective segment can be between 25% to 100% of a given material or density material or hardness material. In addition, while the projectile 60 is set forth as having three segments, it is contemplated the projectile may have two segments, or more than three segments corresponding to the particular material of the segments and the intended performance of the projectile 60.

As shown in FIGS. 56 and 57, the longitudinal segments of different density materials can correspond to nose section 96, the back section 98, the tail portion 120, and the stem 160. For example, in one configuration, the first longitudinal segment is the nose section 96 of the body portion 80, the second longitudinal segment is a back section 98 of the body portion 80, and the third longitudinal section is at least one of the stem 160 and the tail portion 120. In one example, the first longitudinal segment is a nose section 96 of the body portion 80 and the nose section includes tungsten, the second longitudinal segment is the back section 98 of the body portion 80 and the back section includes copper, and the third longitudinal section is one of the stem 160 and the tail portion 120 and the one of the stem and the tail portion include a polymer or polymeric material, such as but not limited to thermosets or thermoplastic polymers, such as but not limited to nylons. It is further contemplated, at least one of the first longitudinal segment and the second longitudinal segment is formed of metal and the third longitudinal segment is polymeric, such as but not limited to thermoplastic, thermoset polymerics including but not limited to nylon. It is contemplated any of the recited materials can include a fiber reinforcing such as but not limited to glass, carbon, aramid, or basalt.

Depending in the construction of the projectile 60, the first longitudinal segment is denser than the second longitudinal segment, and the second longitudinal segment is denser that the third longitudinal segment.

It is also contemplated one of the longitudinal segments of the projectile can include the portion of the projectile forming the bearing surface (or gas check) with the bore 33, wherein this segment of the projectile is formed a relatively low wear material such as copper, or lead, or similar alloys as well as non-metallic materials including but not limited to polymeric materials.

The stem 160 connects the tail portion 120 to the body portion 80. As seen in FIGS. 1-19, the stem 160 has a subcaliber dimension. Depending on the strength of the material of the stem 160 and the intended operating parameters of the cartridge 10, the stem may have a diameter between 20% and 90% of the diameter of the body portion 80 or the bore 33 caliber. Although the stem 160 is shown having a substantially constant diameter, it is contemplated the diameter of the stem can vary along the longitudinal axis. By reducing the diameter of the stem 160 and selection of a relatively low density material (less dense than the body portion), the present design maintains the center of mass of the projectile 60 within the body portion 80. It is contemplated the stem 160 and/or the tail portion 120 can be formed of polymers, ceramics, aluminum, austenitic nickel-chromium-based superalloys, such as Inconel® by Special Metals Corporation, or other material known in the art. For example, it is contemplated that any of the recited materials can include a fiber reinforcing such as but not limited to glass, carbon, aramid, or basalt fibers.

The stem 160 can extend from approximately 15% to approximately 40% of the length of the projectile 60. As seen in the FIGS. 1-19, the stem has a length between 15% and 22% of the length of the projectile. The combined length of the stem 160 and the tail portion 120 can be less than the length of the body portion 80. In certain configurations, the combined length of the stem 160 and the tail portion 120 can be equal to or less than the length of the body portion 80. It is understood, the stem 160 can be as long as possible as limited by the casing 40, wherein the length of the stem contributes to the stability margin. Thus, in one configuration, the stem 160 can be as long as the available length of the casing 40.

In one configuration, the tail portion 120 and the stem 160 are formed of the same material. However, it is understood the tail portion 120 (and tail fins 130) can be a different material than the stem 160, which in turn is a different material (or at least different density) than the body portion 80.

Referring to FIGS. 3, 6, 9, 12, 15 and 18, the projectile 60 can include a cavity 170 extending from the rear end 124 of the projectile through the tail portion 120, the stem 160 and into the body portion 80. The cavity 170 includes a closed end 172, wherein in one configuration the closed end of the cavity is longitudinally within the back section 98 of the body portion. The cross sectional area of the cavity 170 at the rear end 124 of the projectile 60 can be between 25% to 90% of the cross sectional area of the rear end. In one configuration, the cavity 170 has a cross sectional that is greater than a remaining cross sectional area of the rear end 124 of the projectile 60. Referring to FIGS. 6, 9, 11, 12, the propulsive gases acting on the projectile 60 to launch the projectile act along the longitudinal axis on all the surfaces perpendicular to the longitudinal axis. Thus, the spaces between the tail fins 130 expose the rear surface of the body portion 80 to be exposed to propulsion gases. The present design exposes the closed end 172 of the cavity 170 and the rear of the body portion 80 to the majority of the propulsive gases. That is, as force is pressure times area, the present design generates the most force on the body portion 80 of the projectile 60, rather than the tail portion 120. Since the body portion 80 of the projectile 60 is formed of relatively rigid materials that can withstand the pressures generated with the internal ballistics, the action of the propulsion gases on the body portion reduces the forces on the stem 160 and the tail portion 120 that must be accommodated by rigid, and hence heavy materials. Further, the cavity 170 effectively reduces the mass of the stem 160 and the tail portion 120, thereby providing that the center of mass of the projectile 60 can be further dominated by the body portion 80 and hence located further forward along the longitudinal axis.

In one configuration of the cavity 170, it is contemplated that a plurality of radial passages 175 can be formed fluidly connecting the cavity an external surface of the projectile 60 along the longitudinal axis. The radial passages 175 are configured to equalize pressure between the cavity and the exterior of the projectile 60, and particularly during internal ballistics. In one configuration, the radial passages 175 are believed to reduce pressure-induced deformation of the stem 160 and the tail portion 120 during the internal ballistics.

A further configuration of the projectile 60 is contemplated, where the cavity 170 extends from an open end the front of the projectile towards the rear end 124 to the closed end 172. In a further configuration, the cavity 170 can be longitudinally bounded so as to be located entirely within the projectile 60 thereby defining a chamber that is not exposed to an external environment.

Figure 58:
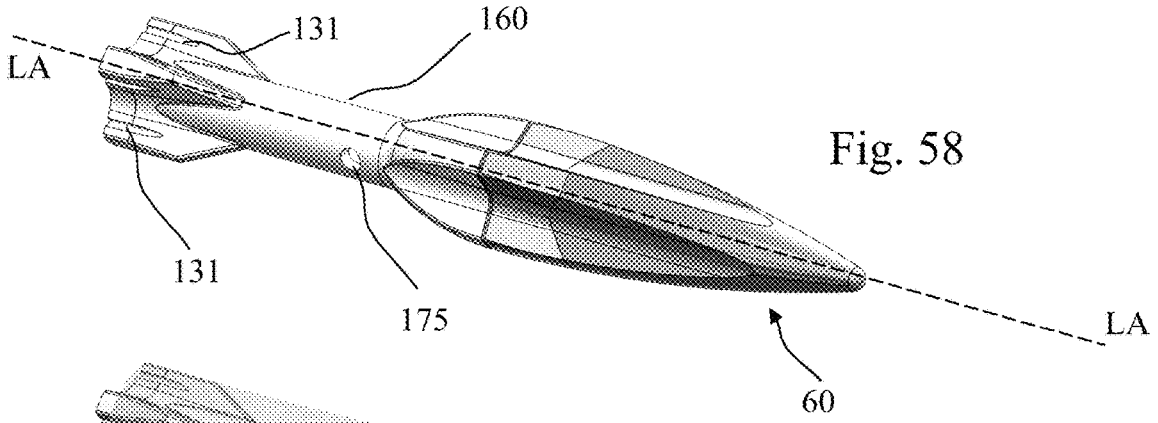
FIG. 58 is a perspective view of a projectile having a bypass channel on a tail fin.
Figure 59:
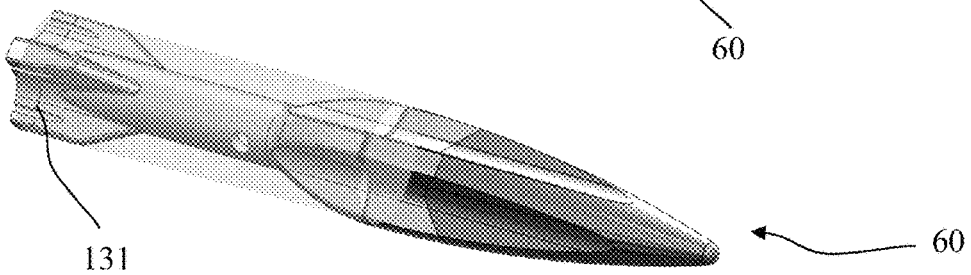
FIG. 59 is the perspective view of a projectile having a bypass channel on a tail fin of FIG. 58 with a schematic representation of a volume of equalized pressure within the bore.
Figure 60:
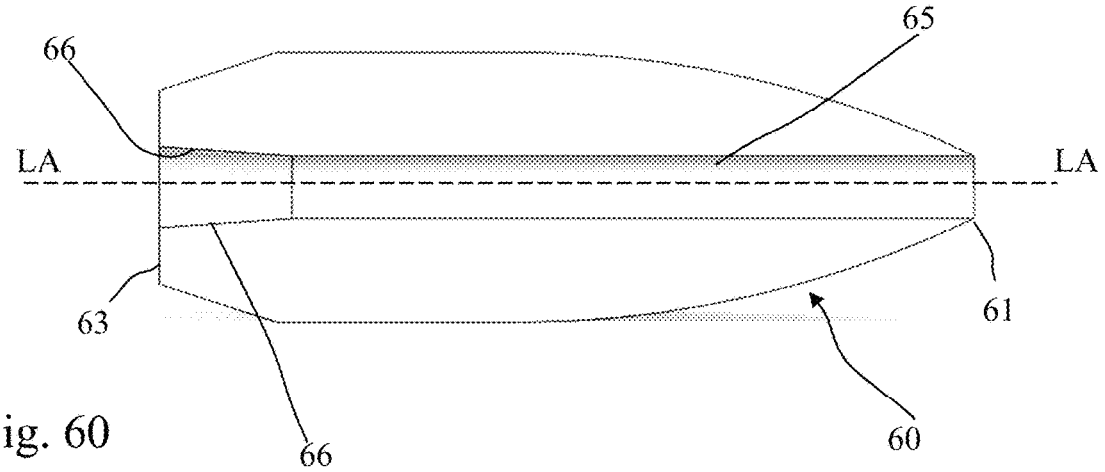
FIG. 60 is a cross sectional view along the longitudinal axis of the projectile having a flow through passage.

An alternative configuration provides for bypass of a portion of the propellant gases between the tail fins 130 and the bore 33 so that the propellant gases passing between the bore 33 and the projectile contact to the body portion 80. As the body portion 80 can be formed of a more rigid, more resilient, or dense material than the tail fins 130, the body portion can better withstand the pressures, temperatures, and resulting forces from the propellant gases. Thus, the tail fins 130 can each define a cross sectional profile perpendicular to the longitudinal axis, wherein the cross sectional profile includes a bypass channel 131 configured to pass propellant gas from a rear of the tail fin to a front of the tail fin. As seen in FIGS. 51, 58, and 59, the bypass channel 131 can be a groove in an exterior surface of the tail fin 130, wherein the bypass channel is configured to pass a propellant gas from a rear end of the tail fin to a forward end of the tail fin. As further seen in the FIG. 51, a portion of the tail fin 130 can form the bearing surface with radially inward projecting inner bore surface 32. Thus, the body portion 80 of the projectile 60 can have a bearing surface intermediate the front end and the rear end of the projectile, wherein the bypass channels 131 are longitudinally intermediate the rear end of the projectile and the bearing surface of the projectile.

Although FIGS. 1-19 show the projectile 60 including both the tail portion 120 and the stem 160, it is contemplated that the tail portion and the tail fins 130 can extend from the rear end 124 of the projectile to the body portion 80, thereby effectively subsuming the stem into the tail portion as seen in FIG. 22. That is, the tail fins 130 can extend from the rear end 124 of the projectile 60 to the body portion 80, wherein the fins include the leading edge 136 configured to deflect air during the external ballistics of the projectile.

Conversely, as seen in FIG. 36-43, the body portion 80 can generally extend to the rear of the projectile, wherein the body portion fins 82 extend along a majority of the length of the projectile. Thus, the body portion 80 can extend rearward to the tail portion 120, as seen in FIGS. 36-43, such that the body portion fins 82 may include lengths along the longitudinal axis having an increasing radial dimension, a length of decreasing radial dimension, wherein the tail fins then define an increasing radial dimension of the fins as the leading edge 136 of the tail fins 130, wherein the increasing radial dimension of the tail fins generate areas of pressure during external ballistics that are rearward of the center of mass of the projectile. Referring to FIGS. 36-43, the tail fins can be continuous with the body portion fins.

In each of the configurations, the flight control surfaces (fins) 70 of the projectile 60 are configured to provide aerodynamic stability at supersonic velocity of the projectile, without requiring or imparting rotation of the projectile or the use of sabots.

In select configurations of the cartridge 10, a portion of the radially projecting flight control surface, such as the tail fins 130 is at least partly disposed within the charge volume 43 within the casing.

For example, in the configuration of the projectile 60 in FIGS. 1-19, the tail fins 130 are located within the casing 40. In the configuration of the projectile having the body portion extending to the tail portion, at least the tail fins 130 are disposed within the casing.

As set forth above, the projectile 60 can include the front end 90 and the rear end 124 with the longitudinal axis extending from the front end to the rear end, and wherein the projectile is coupled to the casing 40 intermediate the front end and the rear end and the flight control surface 70 is located intermediate the coupling and the front end. The flight control surface 70 can be entirely disposed within the casing 40, entirely outside the casing or partly within the casing and partly outside the casing.

Figure 49:
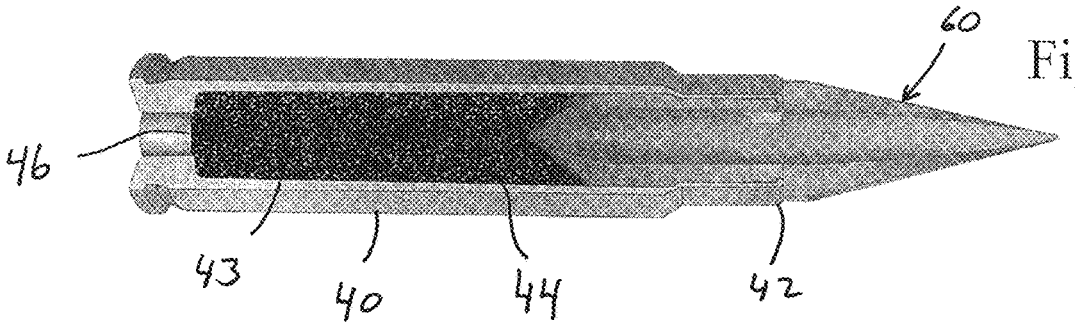
FIG. 49 is a cross sectional view of a further configuration of engagement of the projectile and the casing.
Figure 50:
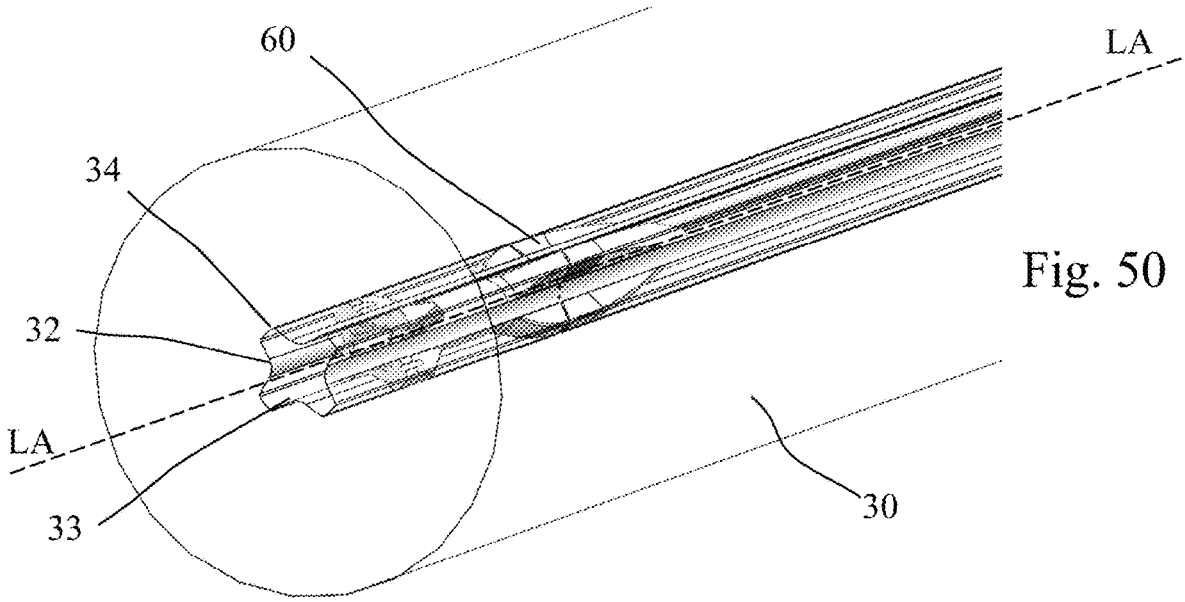
FIG. 50 is a perspective view of a projectile within a bore of a barrel having radially inward directed guide surfaces.

Referring to FIGS. 44 and 49, the casing 40 can include the neck 42 configured to form an interface with the projectile 60 and thus couple the projectile to the casing. Thus, the flight control surfaces 70 can extend between the front end 90 of the projectile and the neck 42, between the rear 124 of the projectile and the neck or across the neck. As seen in FIG. 44, the neck 42 may be formed to have a shape corresponding to the cross section of the projectile, thereby forming a tight seal between the casing 40 and the projectile when manufactured, such that the interface is weatherproof and establishes obturation in a like-shaped chamber upon firing of the cartridge.

In those configurations in which the longitudinally extending fins 82 extend longitudinally across the neck 42, the cartridge 10 can include a peripheral cladding or packing at the interface with the neck 42 of the casing, so that the neck of the casing engages the outermost radial surface of the fin and the cladding or packing to form a sealed interface. Alternatively, a filler can be affixed to the projectile adjacent the flight control surface, thereby forming a portion of an interface with the casing, and typically at the neck. The filler can be combustible or non-combustible. Alternatively, or in addition, the casing can include an accommodating surface for interfacing with the flight control surface.

In a further configuration, the casing 40 can be crimped or deformed about the projectile 60, wherein the casing is constructed and configured to enable sufficient local deformation to form a sealed interface about the flight control surfaces. For example in FIGS. 44 and 49, the casing 40 can be crimped to the projectile 60 either an additional segment(s) of brass or similar material to the interior casing wall, or by some process in which the face edge of the neck portion of the casing is rolled, crimped or folded to conform to the projectile.

In one configuration, the flight control surface 70 is integral to the projectile 60. However, it is contemplated the flight control surface 70 can be separable from the projectile 60, such as a frangible flight control surface. It is further contemplated the frangible flight control surface can be integral with the projectile, with the structure providing for the flight control surface to be frangible.

It is further contemplated that the flight control surface 70 can be moveable from a retracted position to an extended position as well as configurations in which the flight control surface generates lift.

Thus, the projectile 60 can include the body portion 80 connected to the radially projecting longitudinally extending flight control surface, or fin 82, wherein the body portion has a maximum body dimension transverse to the longitudinal dimension and the flight control surface, or fin, defines a maximum fin dimension transverse to the longitudinal dimension, wherein the maximum fin dimension is greater than the maximum body dimension. In select configurations, the maximum fin dimension is the caliber of the bore 33. It is further contemplated, the cartridge 10, and specifically the casing 40, can include external surface features, such as but not limited to ribs, or fins which are configured to align the cartridge and hence projectile 60 with the corresponding profile of the barrel bore 33, so as to properly dispose the projectile relative to the bore and form the bearing surface and function as the gas check upon firing of the cartridge.

Figure 75:
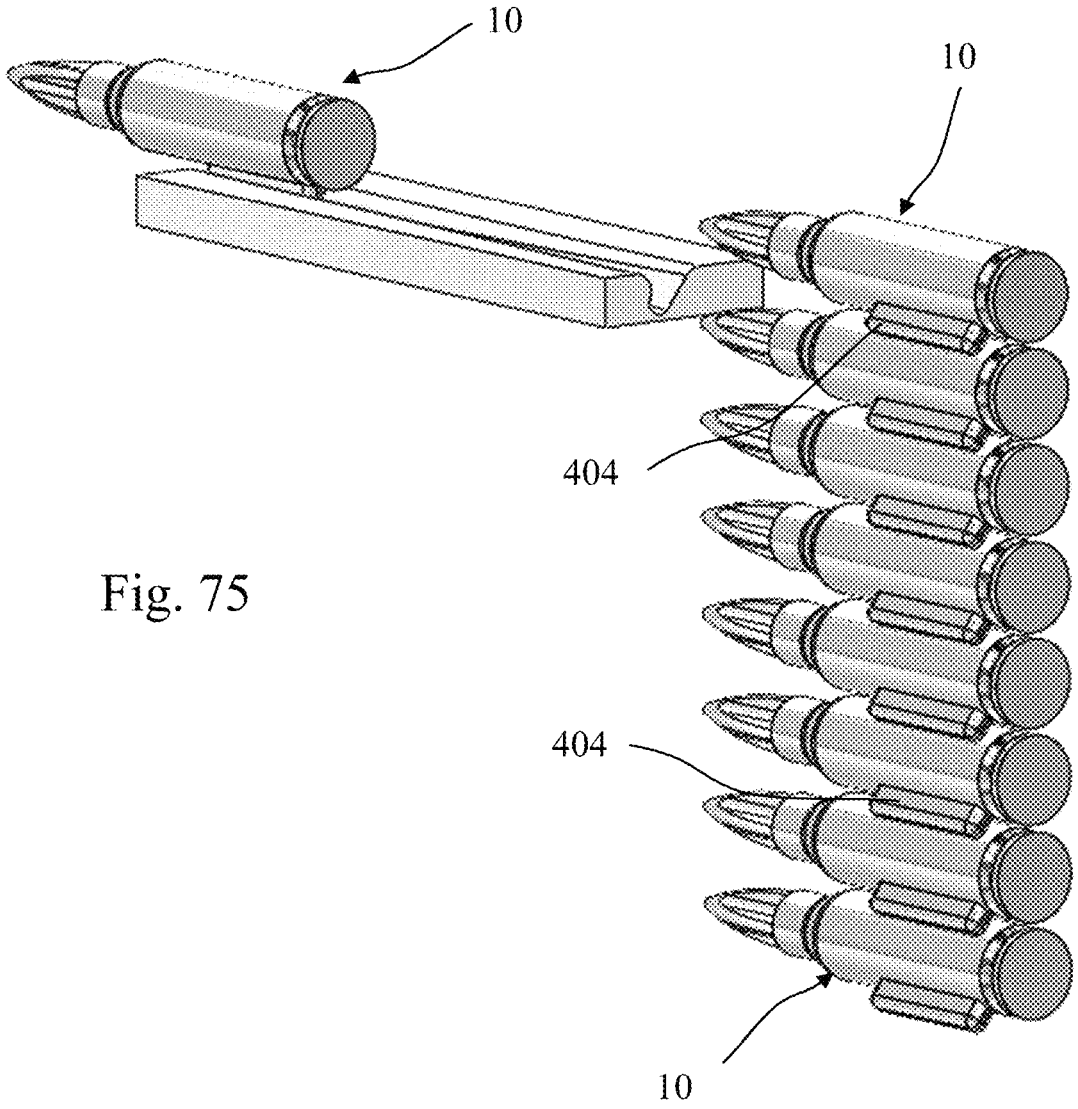
FIG. 75 is a perspective schematic of the cartridge of FIG. 72 cooperatively engaging a guide surface.

Depending on the specific configuration of the projectile 60, the present disclosure further contemplates a magazine assembly having a housing sized to retain a plurality of cartridges 10, each cartridge having a longitudinal axis, the housing having a presenting end and a distal end; a follower disposed within the housing; and a bias member disposed intermediate the follower and the housing, the bias member configured to urge the follower towards the presenting end, wherein the follower includes a groove extending along the longitudinal axis of the cartridge, the groove sized to at least partly receive a portion of a radially projecting flight control surface, casing surface feature, or fin, of one of the plurality of cartridges. The follower can be further configured to present the cartridge at the presenting end such that the flight control surface is within a predetermined location relative to the barrel. Referring to FIGS. 72 to 77, in one configuration, the casing 40 can include an alignment tab 404, wherein the alignment tab can engage the follower to orient the cartridge 10 in a predetermined orientation with respect to the barrel. As seen in FIG. 75-77, the cartridges 10 having the alignment tab 404 can stack in a magazine 420 for selective sequential presentation to the breech. Thus, the casing 40 and the projectile 60 can be disposed in a specific predetermined orientation and indexed or aligned with the barrel and hence bore, and particularly the bore having the lands and grooves.

In addition, as seen in FIGS. 72-74, the casing 10 can include a guide tube 408, wherein the tail portion 120 and particularly the tail fins 130 are sized to slideably pass along an interior of the guide tube. The guide tube 408 includes a plurality of apertures 411 configured to minimize any inhibiting of the combustion of the powder in the casing 40. The guide tube 408 is configured to guide the tail portion 120, and particularly the tail fins 130 as the projectile 60 separates from the casing during the combustion of the powder. That is, as the guide tube keeps the passing tail fins concentric with the longitudinal axis, the projectile 60 maintains a coaxial relation to the bore and the longitudinal axis, thereby reducing variability in the trajectory of the projectile as well as maintaining available energy into forward motion of the projectile. It is contemplated the guide tube 408 is particularly beneficial in accommodating projectiles 60 in the smooth bore.

Figure 61:
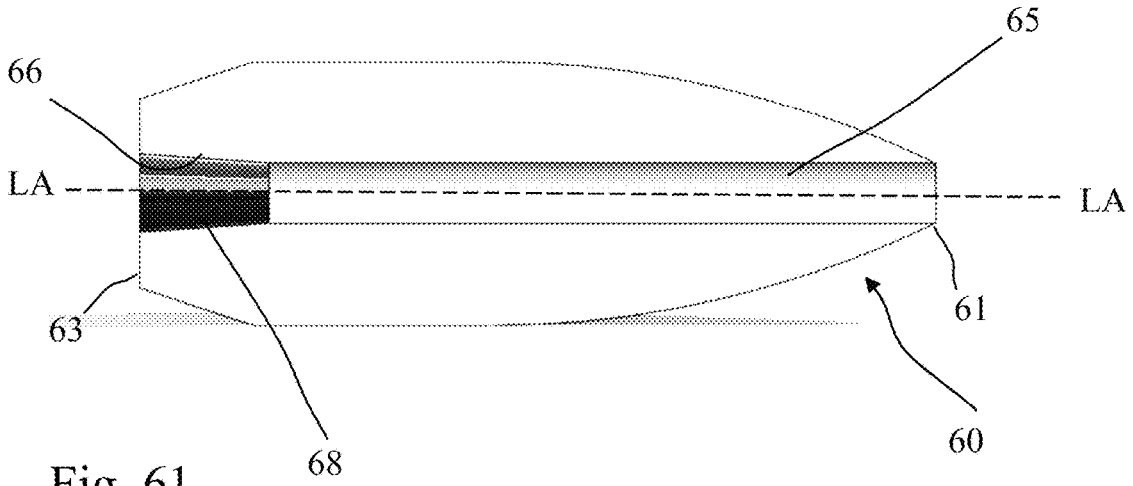
FIG. 61 is a cross sectional view along the longitudinal axis of the projectile having a flow through passage with a packing in the flow through passage.
Figure 62:
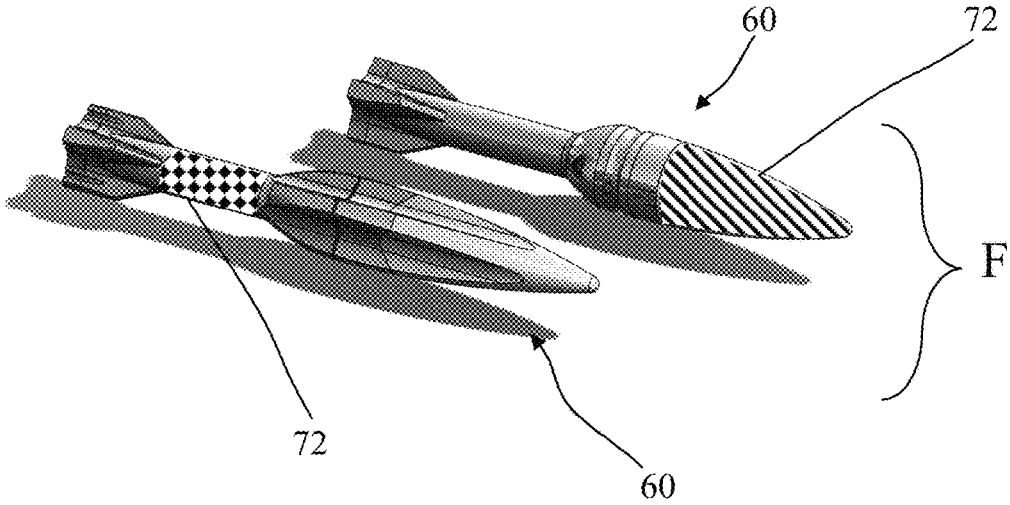
FIG. 62 is a perspective view of a representative cartridge of a first subset of cartridges having a first visual indicator and a representative cartridge of a second subset of cartridges having a second visual indicator.

Referring to FIG. 61, in a further configuration of the projectile 60, the flight control surface 70 is defined by a flow through channel or passage 65 extending from an upstream opening in a leading surface 61 of the projectile, such as in the body portion 80, to a downstream opening in a trailing surface 63 of the body portion, the stem 160 or the tail portion 120. The upstream opening can be radially spaced from the longitudinal axis by a greater distance than the downstream opening. However, it is further contemplated the downstream opening can be further radially spaced from the longitudinal axis than the upstream opening. Further, the downstream opening can be equally radially spaced from the central axis, longitudinal axis LA, as the upstream opening.

In another configuration, the flow through passage 65 can extend along the longitudinal axis LA, thereby forming an annular cross section of the projectile 60, and define a coaxial passage through the projectile. The flow through passage 65 can have a varying radial dimension along the longitudinal axis. For example, a length of the passage 65 adjacent the rear of the projectile 60 can define a flare 66 or increasing radial dimension, which is believed may assist in exterior ballistics of the projectile, such as reducing a drag force on the projectile in external ballistics by having a lower coefficient of drag. In addition, the flow through passage 65 may define a throat or radial constriction along the longitudinal dimension intermediate the leading surface of the projectile 60 and the trailing surface of the projectile.

As shown in FIG. 61, the flow through passage 65 can include a wadding or packing 68 in the flow through passage, wherein the packing is configured to resist flow of propellant gases from the trailing end of the projectile 60 to the leading end of the projectile during firing of the cartridge. Thus, the packing 68 can function as a temporary plug in the flow through passage 65 during at least a portion of the internal ballistic environment of the projectile 60. However, the packing 68 is configured to combust or fragment, such that upon exiting the barrel 30, the flow through passage would be open and not occlude by the packing.

The projectile 60 can be a homogeneous construction. That is, while the material of the projectile 60 made be a specific composition of a variety of different materials, the composition of the projectile is homogeneous throughout the projectile. The materials of the projectile 60 include any of a variety of commercially available materials used for projectiles.

Figure 42:
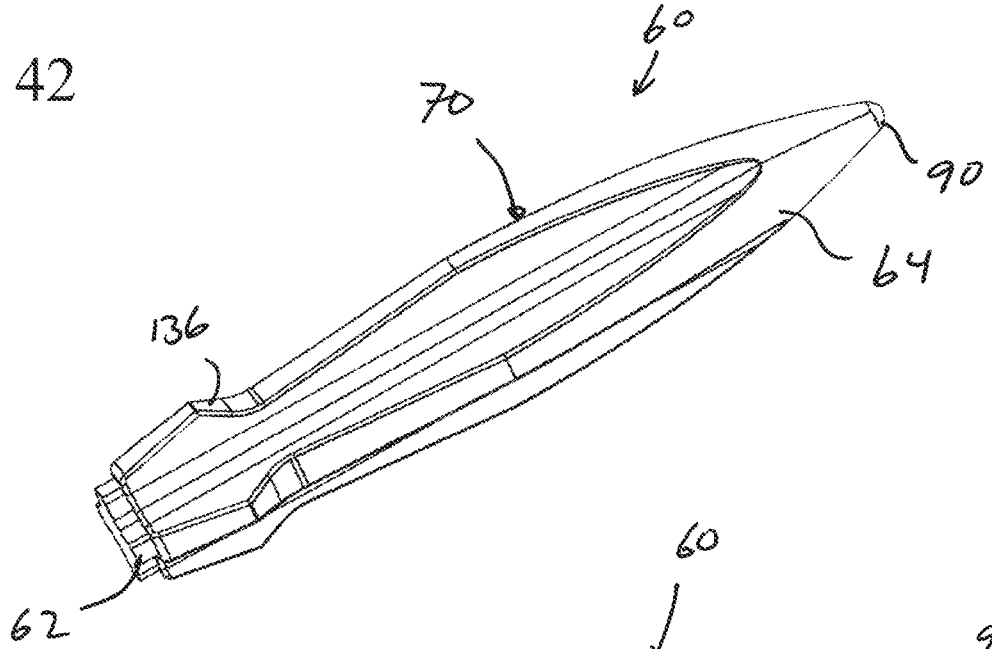
FIG. 42 is a perspective view of the projectile of FIG. 39.
Figure 43:
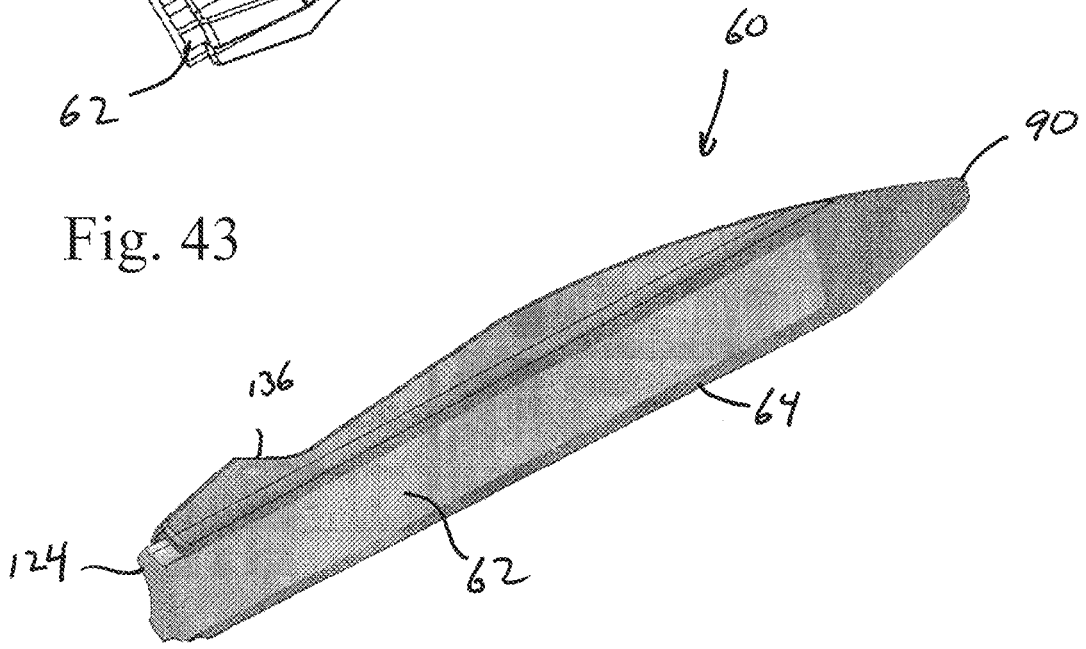
FIG. 43 is a cross sectional view of the projectile of FIG. 39 taken along the longitudinal axis.

In addition to the different portions of the projectile 60 being formed of different materials, as set forth above, it is contemplated that in one configuration, the projectile, or at least a portion of the projectile, such as the body portion 80, can include a core 62 having a cladding 64 extending over at least a portion of the core, as seen in FIGS. 41-43. It is contemplated the cladding 64 can encompass the core 62, or extend along a majority of the length of the core. It is anticipated the cladding 64 is symmetrically disposed about the core 62 about the longitudinal center line of the core. The cladding 64 can be a plating or coating on the projectile, or selected portions of the projectile 60. The cladding 64 can include copper, alloys, or polymers which are configured to reduce wear of the barrel, such as leading of the barrel. For example, in plating copper on the projectile 60, the copper plate is typically between approximately 0.0002 to 0.0004 inches thick, wherein the plating can be an electroplating or an electroless plating process. Depending on the desired thickness of the cladding, multiple platings can be applied. The cladding 64 can be include graphite or polytetrafluoroethylene (PTFE) to reduce wear of the barrel 30.

With respect to cross sectional relation of the core 62 to the cladding 64, the majority of the cross-sectional area for a majority of the length of the projectile, or a portion of the projectile, such as the body portion, can be formed by the core. However, it is anticipated that terminal ends of the projectile 60 are formed entirely by one of the core 62 or the cladding 64. Thus, the core 62 can form a portion of the body portion fins 82, including the primary and the secondary fins 84, 86, wherein the cladding 64 forms the outer, or exposed, surface of the fins as well as the tail fins. Alternatively, the body portion 80 and/or tail fins 130 can be entirely formed of the cladding 64. That is, in the configuration of the core 62 having a cylindrical configuration, the cladding can define the radially projecting fins.

In one configuration, the core 62 has a greater density and is harder than the cladding 64. Typically, the core has a greater Brinell hardness than the Brinell hardness of the cladding. For example, the core 62 can be formed of tungsten and the cladding 64 formed of copper, or lead. However, other material choices are available with departing from the present disclosure and preserving the relative hardness and density between the core and the cladding. Additional available materials for at least portions of the projectile 60, such as the body portion 80, the stem 160, and/or the tail portion 120 include those as listed herein as well as aluminum, aluminum alloys, and elastomers, including thermosets and thermoplastics, including but not limited to nylon. It is contemplated that any of the recited materials can include a fiber reinforcing such as but not limited to glass, carbon, aramid, or basalt fibers.

For example, representative materials of the core and cladding include tungsten having a density of approximately 19000 kg/m$^{3,}$ and copper having a density of approximately 8900 kg/m$^3$. However, it is understood that lead can be used in one of the core or the cladding. Further, the materials can be selected to provide that the surfaces that contact the bore are formed of less abrasive or detrimental to the material of the bore than the remaining materials of the projectile.

In one configuration, the materials of the core 62 and the cladding 64 are selected to locate a center of mass of the projectile 60 in accordance with existing projectiles, so as to minimize retraining when employing the present cartridge. It is further contemplated the materials of the core 62 and the cladding 64 are selected and the core and cladding sized to locate a center of mass of the projectile towards the front of the projectile 60.

The ratio of the mass of the core 62 to the mass of the cladding 64 is at least 1:1 and in further configurations 1.2:1, and in further configurations the ratio can be 1.4:1 and in select configurations, 1.5:1 or more. It is contemplated that the composite structure of the projectile 60 may provide terminal advantages at longer distance impacts, as the cladding 64 can separate from the core 62 and thus distribute within the target without requiring adding impact energy.

Figure 65:
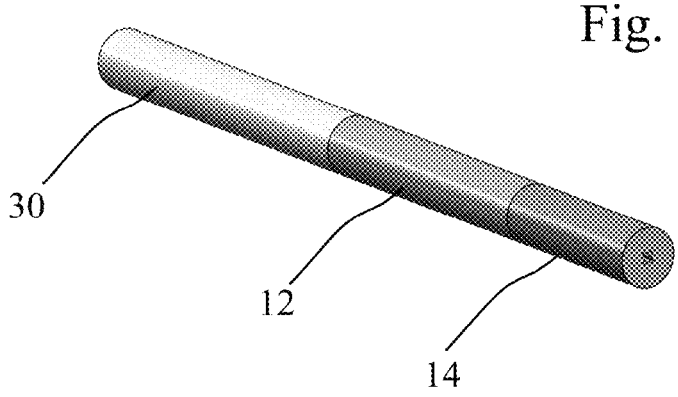
FIG. 65 is a perspective view of a barrel assembly having a plurality of barrel segments.

In the configuration of the projectile 60 including the core 62 and the cladding 64, the cladding forms the outer surface of the projectile as the projectile is disposed in the cartridge 10. This configuration, the outer surface of the projectile can be free of fins, and is thus exhibits a length having a cylindrical profile extending along the longitudinal axis, with leading end 90 being tapered or ogive. The cylindrical profile forms the interface with the casing, such as at the neck 42 of the casing 40. In this construction, it is further understood the cylindrical profile can include different circumferences along the longitudinal dimension. In this configuration, the cladding 64 is formed of a relatively soft or malleable material and the barrel 30 includes shaping surfaces that impart radially projecting longitudinally extending (non-helical) flight control surfaces 70, such as fins, as the projectile 60 passes along the bore 33 of the barrel. In this configuration, the fins 70 may have a reduced radial dimension, such as less than 25% and in certain configurations, less than 10% and less than 5% of the diameter, or radius, of the projectile 60. Further, as set forth below, the barrel 30 or a muzzle brake, such as extension 14 of FIG. 65, can provide honing of the passing projectile 60. For example, the projectile 60 can be honed so as to true up the projectile, such as but not limited to with or without fins, or other surface features. It is anticipated in the composite configuration of the projectile 60, that the incorporation of lubricants or lubricious material will lengthen the operating life of the barrel 30. The formed flight control surfaces 70 are generated to impart external ballistic stability to the projectile 60.

It is contemplated the present cartridges 10 can be configured to accommodate wear of the barrel 30, and specifically the bore 33. For example, after a typical number of firings, the bore 33 may have a slightly increased radial bore dimension, as compared to the "as manufactured" bore diameter or dimensions. This wear is a natural phenomenon that occurs in all barrels given enough time, and can be manifested in a few different ways such as changes in bore dimensions of a few thousandths to a hundredth of an inch as well as cracks and pits in the bore (these were likely imperfections present in the barrel during the time of manufacturing that "grow" over time under the intense heat and pressure). While one solution has been to replace the used barrel with a new barrel, the present disclosure contemplates configuring subsets of cartridges 10 to different nominal specifications to accommodate wear of the barrel 30 and bore 33. Specifically, as the bore 33 is anticipated to increase in a cross sectional dimension, to compensate for this barrel wear, the present cartridges 10 can be provided in various nominal dimensions, wherein a subset of cartridges at a given nominal dimension have a unique associated visual indicator 72. The visual indicator 72 is a visual distinction between the appearances of the cartridges 10, wherein the distinction can be ready observed by the naked eye. The visual indicator 72 functions as a "marker" that helps users quickly locate the cartridge 10 that is a member of the first subset or the second subset, and particularly where members of the first subset would not otherwise be distinguishable from members of the second subset with the naked eye. For example, a change in the nominal diameter of the projectile of 0.0003 inches is not observable to the naked eye. However, the operator can readily distinguish the first color or first patterned cartridge 10 or projectile 60 from the second color or patterned cartridge or projectile.

Thus, the present disclosure provides a set of cartridges 10 having a first subset of the set of cartridges having projectiles 60 of the first nominal diameter transverse to the longitudinal axis and the first visual indicator 72; and the second subset of the set of cartridges including cartridges having projectiles of the second nominal diameter transverse to the longitudinal axis and the second visual indicator 72, the second nominal diameter being greater than the first nominal diameter and the second visual indicator being different from the first visual indicator. The visual indicator 72 of the given subset can be on the casing 40, the projectile 60, or both depending on the type of visual indicator. The change in nominal diameter of the projectile 60 between subsets can be between approximately 0.0001 inches and approximately 0.0020 inches, with an anticipated range of between approximately 0.00005 inches to approximately 0.0005 inches.

The shaping surfaces of the barrel 30 can be used to impart the flight control surfaces 70. Alternatively, the muzzle brake can include the shaping surfaces, thereby locating these relatively high wear surfaces in a modular component of the barrel 30 that can be readily replaced. It is further contemplated the shaping surfaces can be located in both the barrel 30 and the muzzle brake, thereby at reducing the wear on surfaces of the barrel.

Figure 63:
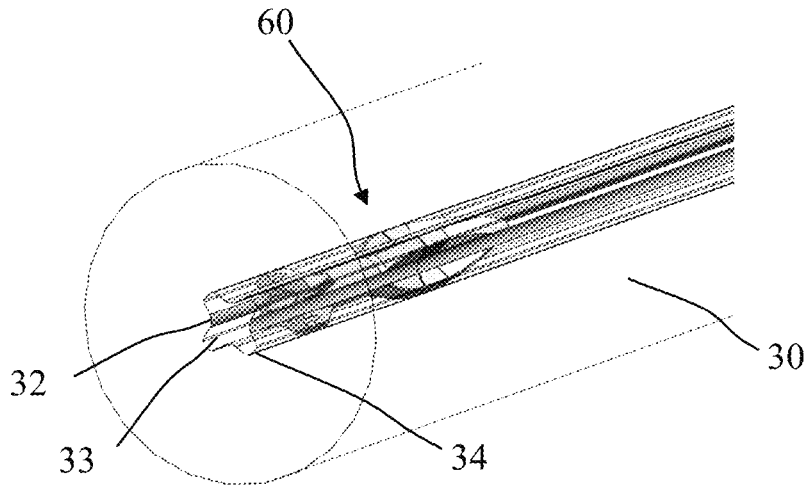
FIG. 63 is a perspective view of a length of the barrel showing the bearing surfaces on a portion of the projectile.
Figure 64:
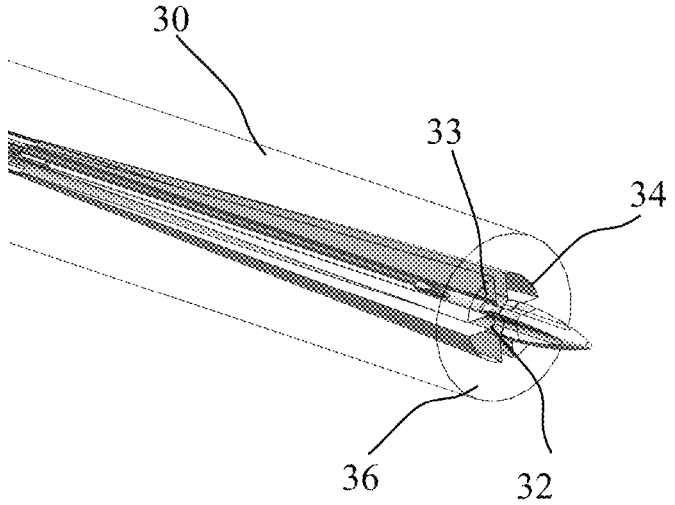
FIG. 64 is a perspective view of a length of the showing the bearing surfaces on a portion of the projectile and portions of the bore diverging from the longitudinal axis.

In a further configuration, seen in FIGS. 63 and 64, it is contemplated the bore 33 can have a cross sectional profile including the radially inward projecting guide surface 32 extending parallel to the longitudinal axis and the outer bore surface, such as the radially outwardly extending grooves 34, extending parallel to the longitudinal axis wherein the outer bore surface forms a bearing surface with a first portion of the projectile 60 at a first longitudinal position along the bore 33 and the outer bore surface is radially spaced from the first portion of the projectile at a second longitudinal position along the bore, and particularly where the second longitudinal position along the bore is nearer the muzzle 36 of the barrel 30 than the breech 35 of the barrel.

That is, the bore 33 can be configured to have at a first longitudinal position along the bore, the inner bore surface 32 and the outer bore surface 34 defining a corresponding first radial spacing and a second radial spacing from the longitudinal axis and at a second longitudinal position along the bore, the inner bore surface is at the first radial spacing and the outer bore surface is at a third radial spacing, wherein the third spacing is greater than the second radial spacing. Thus, with a corresponding projectile 60, at the first longitudinal position along the bore 33, the inner bore surface 32 and the outer bore surface 34 form bearing surfaces with the projectile and at the second longitudinal position along the bore, the inner bore surface remains a bearing surface with the projectile and the outer bearing surface is spaced from the projectile, thereby permitting blowby, where blowby is the escaping of gases passed a fired projectile while the projectile is still in the bore 33.

That is, the bore 33 can be configured with the inner bore surface 32 and the outer bore surface 34 at a first longitudinal position each defining a bearing surface with the projectile 60, and at a second longitudinal position, the outer bore surface has a radial dimension configured to permit the passage of a propellant gas between the outer bore surface and the projectile.

In current firearms, the barrel is rifled with a particular twist rate, i.e. 1 turn in 7 inches (1:7). The twist rate limits the performance of the firearm in that a projectile can only be rotated at a specific RPM (twist rate). Also, a drop in performance is regularly noted in conventional systems when a heavier or lighter bullet, confined to a specific twist rate, is rotated at an inappropriate RPM. The present disclosure contemplates the use (interchangeability) of a variety of muzzle brakes to impart corresponding different twist rates, thus allowing for the user to select an appropriate muzzle brake device dependent on the desired performance of the projectile. Thus, the end user can select a wider range of cartridges 10 that can be stabilized regardless of projectile (bullet) weight without compromising terminal performance. The detachable muzzle brake or muzzle device having rotation imparting surfaces can effectively convert a traditional barrel into a multi-platform variable projectile specific firearm 20. That is, a plurality of muzzle brakes can be provided, wherein each muzzle brake includes a specific twist rate and can be operably engaged/disengaged with the barrel to accommodate different weight projectiles, without having to switch barrels 30 or firearm.

Alternatively, the barrel assembly 10 can include a plurality of longitudinally extensions 12, 14. As the bore 33 includes the inner bore surface 32 and the outer bore surface 34 extending parallel to the longitudinal axis, a longitudinal alignment can be readily provided between longitudinal extensions of the barrel, thereby providing for selectively changing the effective length of the barrel. In one configuration, the barrel 30 is configured to operatively engage the receiver, the barrel having the receiver end (or breech) and the muzzle 36, the barrel including the bore 33 extending along the longitudinal axis from the breech to the muzzle, the bore having a muzzle cross section perpendicular to the longitudinal axis, the bore including a radially inward projecting guide surface extending parallel to the longitudinal axis; and the barrel extension 12 having a coupling end and a second muzzle, the coupling end configured to engage the barrel 30, the second bore extending along the longitudinal axis, the second bore including a second radially inward projecting guide surface extending parallel to the longitudinal axis, wherein the radially inward projecting guide surface and the second radially inward projecting guide surface are colinear.

Figure 66:
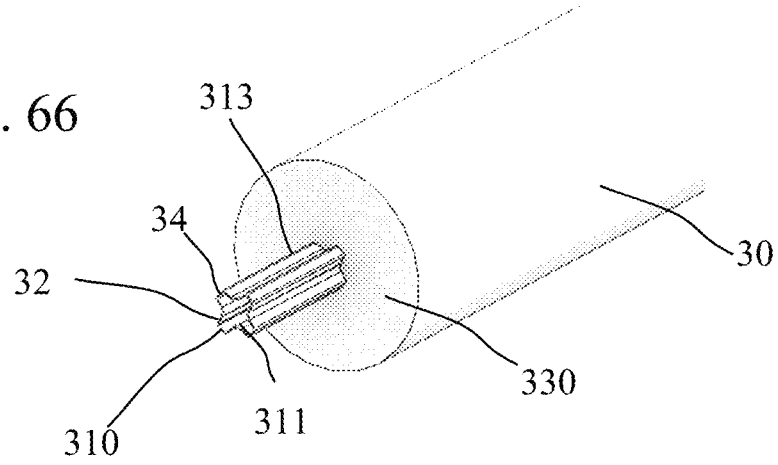
FIG. 66 is a perspective view of a barrel having an inner sleeve and a barrel body.

Referring to FIG. 66, the barrel 30 can be constructed to include an elongate inner sleeve 310 extending along the longitudinal axis, the inner sleeve having an interior surface 311 defining the bore 33 having the radially inward projecting guide surface 32 and the radially outward projecting guide surface 34 extending along and parallel to the longitudinal axis and an exterior surface 313 defining a periphery of the inner sleeve; and a barrel body 330 disposed about the periphery of the inner sleeve. In one configuration, the barrel body 330 is integrally affixed or bonded to the inner sleeve 310, so as to preclude non-destructive separation. The inner sleeve 310 can be an extruded component, wherein depending on the material having a thickness between approximately 0.005 inches to 0.2 inches. The inner sleeve 310 can be of a material to accommodate wear from the projectile 60, where the material is relatively expensive. However, as only the inner sleeve 310 is formed of the expensive material, the barrel body 330 can be formed of a relatively less expensive material. However, it is understood, the inner sleeve 310 can be formed of the relatively less expensive material and the barrel body 330 is formed of a more expensive material.

Figure 67:
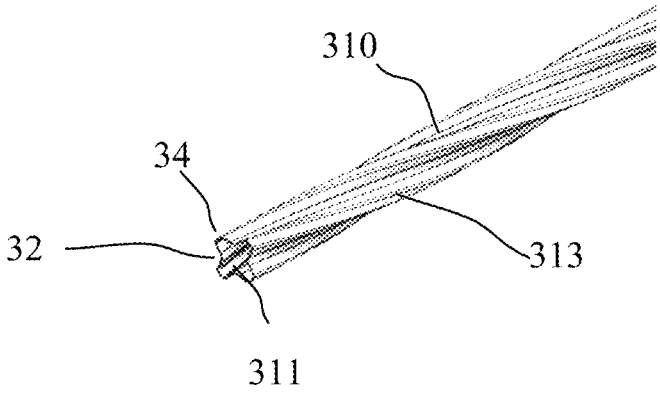
FIG. 67 is a perspective view of an alternative configuration of the inner sleeve.

For example, the inner sleeve 310 can be formed of SAE 4140 chrome-molybdenum or "chrome-moly" steel; stainless steel alloys such as 416R and the barrel body 330 can be can be a variety of materials that provide sufficient structural rigidity and strength to withstand the intended projectiles 60 passing through the inner sleeve. In one configuration, the barrel body 330 is a solid, such as a steel carbon steels including but not limited to 1020 and 1520; 4140, ordnance steel or chrome-moly steel, having 0.4 percent carbon; 4150 having the carbon content to 0.5 percent; 41V45 a chrome-moly variant, as well as 8620 having an alloy of nickel, chromium, molybdenum, with 0.2 percent carbon. Additional materials include stainless steels such as 316, or marine grade stainless, and 17-4, an alloy with 17 percent chromium and 4 percent nickel. Further materials include aluminum alloys, such as 6061 or aircraft aluminum, and 7075, sometimes referred to 7075-T6. Depending on the material and thickness of the inner sleeve 310, the barrel body 330 can also be formed of carbon fiber, fiber glass, metal-matrix composites, or ceramics. In one configuration, the barrel body 330 is a one piece construction, such as but not limited to a molded or cast body, wherein the barrel body can be homogeneous. Although the inner sleeve 310 is shown having the inner and outer bore surfaces 32, 34 being parallel to the longitudinal axis, it is understood the inner sleeve can be helical about the longitudinal axis, as shown in FIG. 67.

In one method, the barrel assembly can be formed by extruding the inner sleeve 310 to define the bore 33, the bore having the radially inward projecting guide surface 32 and the radially outward projecting guide surface 34 extending along the longitudinal axis and the exterior surface 313 defining a periphery of the sleeve 310 and embedding the periphery of the inner sleeve in the barrel body 330. It is contemplated the embedding can include entombing or casting the inner sleeve 310 so as to encompass the inner sleeve, and specifically the exterior surface of the inner sleeve.

Figure 68:
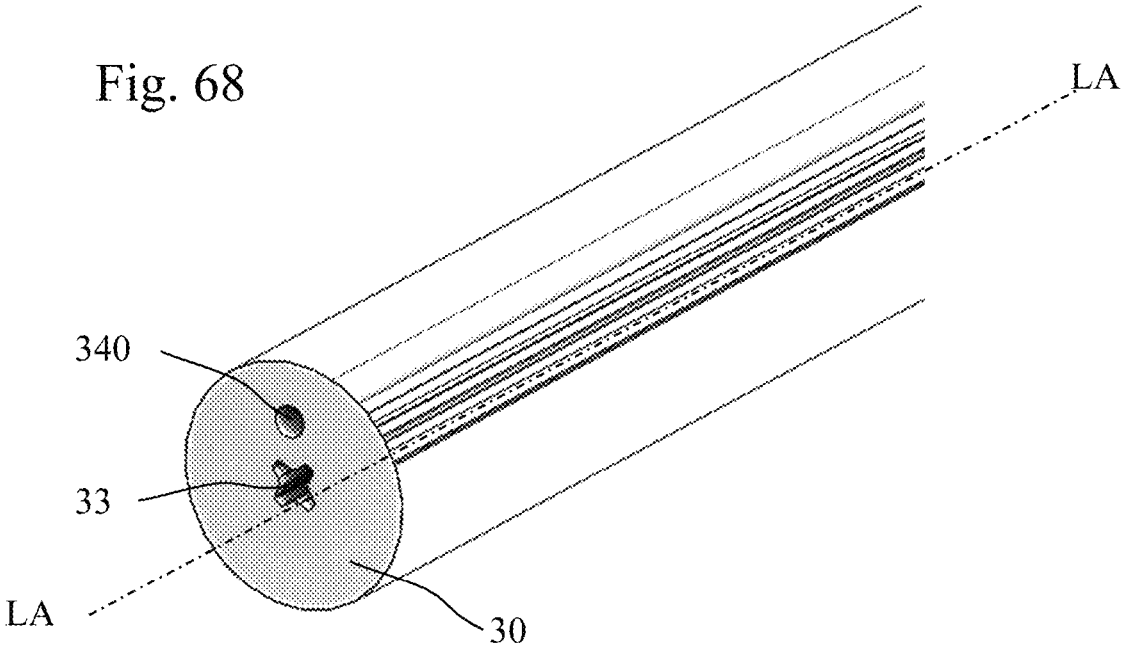
FIG. 68 is a perspective view of the barrel having a gas duct.
Figure 69:
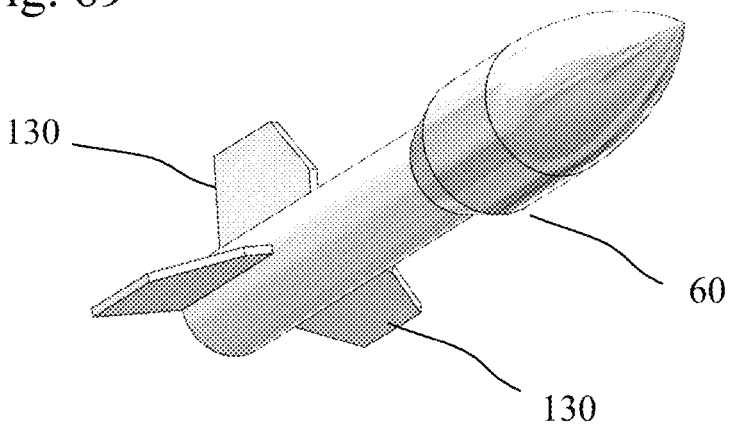
FIG. 69 is a perspective view of a configuration of the projectile having lift generating tail fins.

Referring to FIG. 68, the barrel 30 can also include a gas duct 340 extending along the longitudinal axis, wherein the gas duct is configured to transmit propellant gas from a muzzle portion of the barrel to a breech or breech portion of the barrel, wherein the transmitted propellant gas is used in a conventional system to provide energy to power a gas operation of the firearm. In the gas-operation, a portion of the high-pressure gas from the cartridge 10 being fired is used to power a mechanism to dispose of the spent case and insert a new cartridge into the chamber. Energy from the propellant gas is harnessed through the gas duct 340 in the barrel 30. The high-pressure propellant gas impinges on a surface such as a piston head and can be used to provide motion for unlocking of the action, extraction of the spent case, ejection, cocking of the hammer or striker, chambering of a fresh cartridge, and locking of the action.

The barrel 30 extends along the longitudinal axis between the breech end and the muzzle, the barrel having the bore 33 extending along the longitudinal axis, the barrel having a cross sectional profile perpendicular to the longitudinal axis, cross sectional profile including a contiguous portion, wherein the contiguous portion includes a cross section of the gas duct 340. That is, the gas duct 340 is integral with the barrel 30. The gas duct 340 extends integral with the barrel 30 in the contiguous portion of the barrel parallel to and along the longitudinal axis LA, as seen in FIG. 68, and intersects, or fluidly communicates with the bore 33 intermediate the breech of the barrel and the muzzle 36 of the barrel. Depending on the anticipated operating pressures of the gas passing through the gas duct 340, it is contemplated the contiguous portion of the barrel cross section has sufficient strength to withstand the passage of the propellant gas through the gas duct.

Referring to FIGS. 23-36, in one configuration, the cartridge 10 includes a cradle 200 for at least partly forming the interface between the projectile 60 and the casing 40. As seen in the FIGS. 23-35, the cradle 200 includes a plurality of fingers 210 sized to be received between consecutive fins 70 of the projectile 60. The fingers 210 can be joined by a retaining ring 212, to form a single integral unit.

Depending on the configuration of the fins 70, 82, 84 or 86, the fingers 210 of the cradle 200 (in combination with the exposed radial portion of the fins) or the retaining ring 212 can define the interface with the casing 40. In either configuration, the combined cross section of the cradle 200 and the projectile 60 define the plug at the interface with the casing 40, thereby sealing the powder in the casing. The cradle 200 and the projectile 60 are configured to define a plug at the interface with the casing. The plug precludes, or at least inhibits the passage of propellant from the casing 40. The cradle 200 and the casing 40 can be separate and separable components, or integral, wherein the integral formation can be through manufacture in a common material or interconnection which precludes non-destructive separation. In either configuration, the cradle 200 and the casing 40 are constructed to preclude the cradle from passing into the bore 33 upon firing of the cartridge 10.

As seen in the FIGS. 23-25 and 31-35, the fingers 210 have an inner surface 214 configured to mate with the cross section of the projectile 60 as defined by adjacent fins 70, 82, 84, or 86. An outer surface 216 of the finger 210 defines a portion of a circular periphery sized to cooperatively engage a portion of the casing 40, such as the neck 42 of the casing.

In one configuration, the outer periphery of the fingers 212 and the exposed outer surface of the fins 70, 82, 84, or 86 define a substantially circular periphery which is engaged by the casing 40, such as the neck 42. However, it is understood the outer surface 216 of the fingers 210 can radially extend beyond an adjacent portion of the fins 70, 82, 84, or 86 and thus the cradle 200 can form the contact surface with the casing 40 as the adjacent portions of the fins are recessed for the exterior of the fingers. In this configuration, the plug is formed at a different longitudinal location of the cross section of the projectile 60 and the cradle 200.

In a further configuration of the cradle 200, the cradle is a sleeve that includes an internal passage having a cross section compatible with the cross section of the corresponding portion of the projectile 60. In this configuration, the cradle 200 forms the interface with the casing 40, independent of the fins 70, 82, 84, or 86. It is contemplated that the cradle 200 remains in the spent casing 40, having its seal broken at the casing neck 42 when the projectile 60 is released under pressure of ignited propellants during firing. As set forth above, the cradle 200 is thus retained within the casing 40 and does not enter the bore upon firing of the cartridge 10.

The barrel 30 of the corresponding firearm includes the longitudinally extending lands 32 or grooves (guide surfaces) 34 configured to slidably receive the fins 70, 82, 84, or 86 of the projectile 60. Thus, upon chambering the cartridge 10, the fins 70, 82, 84, or 86 of the projectile 60 are operatively aligned with the corresponding guide surfaces 34 extending longitudinally along the barrel 30.

Correspondingly, a lead end 218 of the fingers 210 of the cradle 200, or the retaining ring 212 of the cradle are thus aligned with the land areas 34 of the barrel 30 which preclude movement of the cradle along the longitudinal axis of the barrel.

Thus, upon firing of the cartridge 10, the propellant converts to gas which acts on the plug formed by the cross section of the projectile 60 and the cradle 200. Movement of the cradle 200 along the longitudinal direction from the expanding gas is at least partly blocked by the cradle, as the cradle abuts the shoulders of the lands 34 of the barrel 30, and the expanding gas propels the projectile 60 from the casing 40 and along the barrel. In one configuration, the guide surfaces (lands 34 and/or grooves 32) of the barrel 30 extend parallel to the longitudinal axis and are free of any twist or helical inclination.

Thus, the cradle 200 can be sized to limited movement in the longitudinal direction in response to firing of the propellant. That is, the cradle 200 can be configured to locate the front end of the cradle, such as the lead end 218 of the fingers 210 adjacent to the stop shoulders of the lands 34 of the barrel 30 upon operably locating the cartridge 10 in the chamber. However, it is further contemplated that the function of the cradle 200, such as the fingers, can be performed by extensions of the barrel grooves and/or lands into corresponding configuration of the casing 40 to provide additional guidance of the projectile 60 during firing as the projectile moves from the casing to and through the bore 33.

The cradle 200 can be formed of a variety of materials including polymers, such as but not limited to ultrahigh molecular weight polyethylene, UHMWPE, as well as the material of the casing 40 so as to be either integral with the casing or a separate component.

As seen in the FIGS. 26 and 27, the inner surface 214 of the cradle 200 and particularly the inner surface of the fingers 212 can include a releasable lubricant or lubricious material to be distributed along a portion of the interface between the projectile 60 and the barrel 30. Dry lubricants can be deposited on the inner surface 214 of the cradle 200 so that as the projectile 60 moves relative to the cradle during firing, some of the dry lubricant is carried by the projectile and thus becoming operably located intermediate the projectile and the barrel 30. Available dry lubricants include graphite, talc, and molybdenum disulfide as well as hexagonal boron nitride (white graphite) and tungsten disulfide. It is anticipated the use of the dry lubricants will lengthen the operating life of the barrel life. In a further configuration, a select projectile 60 can include a lubricious and/or cleaning cladding or coating, configured to provide that upon firing the cartridge 10 having the coated projectile, the lubricant and/or cleaner is contacted with the bore. It is further contemplated that depending on the particular lubricious and/or cleaning material that the projectile 60 can be formed of, or include components formed of the lubricious and/or cleaning material, wherein such components distribute the material to the bore 33 during the internal ballistics of the cartridge 10.

It is understood that a portion of the gas resulting from the combustion of the propellant (such as the powder) may pass along the barrel 30 alongside or even ahead of the projectile 60. As seen in the FIGS. 45-47, the gas exiting from the muzzle 36 will act on both the muzzle and the projectile 60. It is theorized that by providing the relatively tangential surfaces as defined by the flight control surface 70, 82, 84, or 86, such as the transition from fin to groove, the expanding gas may act to stabilize the projectile 60 as it passes from the barrel 30, thus providing an intended trajectory of the projectile without imparting any rotation. The generated gas acting on the projectile 60 may be used to stabilize the projectile as the projectile exits the muzzle 36. That is, the gas can act on the relatively large surfaces of the flight control surfaces 70, 82, 84, or 86 that are transverse to the longitudinal axis of the barrel 30.

Conversely, it is contemplated that a shaped portion of the barrel proximate to the muzzle 36 can impact the expanding gas with the projectile 60 to impart a spin of the projectile about the longitudinal axis of the projectile.

Alternatively, as seen in FIG. 48, the guide surfaces 32, 34 of the barrel 30 can be used to act on the flight control surface and impart a rotation to the projectile. Thus, the barrel 30 can be configured to impart the projectile stabilization or impart the rotation to the projectile.

Alternatively, the muzzle brake can be employed to impart the spin of the projectile 60 (either by guide surfaces in the muzzle brake or directing the impacting expanding gas) or to direct an expanding stabilizing gas pattern to impact the projectile 60 to stabilize the projectile as it leaves the muzzle 36. That is, the muzzle brake can include surfaces for contacting the flight control surface 70, 82, 84, or 86 to impart the rotation of the projectile 60. The guidance of the projectile 60 by guide surfaces wears the guide surfaces 32, 34 and causes a finite operable life of the guide surfaces, and thus barrel 30. However, by locating the guide surfaces in the muzzle brake, the wear can be borne by the readily replaceable muzzle brake rather than the more expensive barrel 30.

It is further contemplated, that to reduce barrel wear from rotation of the projectile 60 relative to the barrel 30, the barrel can be indexed or rotated to impart a rotation of the projectile. However, it is recognized that the energy required to move the mass of the barrel 30 or even a rotatable portion of the barrel may be detrimental to the otherwise available energy to the projectile 60.

Thus, the present disclosure provides the sabot free cartridge 10 for the firearm having the barrel 30 with the bore 33 having non-helical longitudinally extending guide surfaces, the cartridge including the casing 40, the projectile 60 coupled to the casing to define a charge volume, the projectile extending along a longitudinal direction; and the solid propellant retained within the charge volume; wherein the projectile includes the radially projecting flight control surface, the radially projecting flight control surface 70, 82, 84, or 86 extending longitudinally along at least 50% of a length of the projectile and sized to by slideably received in the non-helical longitudinally extending guide surface of the bore. It is further contemplated the flight control surface includes a plurality of radially projecting fins, and further wherein each of the plurality of radially projecting fins extends at least 25%, to at least 50%, to at least 75% and in some configurations at least 90% of a length of the projectile. In one configuration, a portion of the radially projecting flight control surface is at least partly disposed within the charge volume. The projectile 60 includes front end 90 and a rear end 124 with a longitudinal axis extending from the front end to the rear end, and wherein the projectile is coupled to the casing 40 intermediate the front end and the rear end and the flight control surface 70, 82, 84, or 86 is located intermediate the coupling and the front end. The casing of the cartridge can include a neck 42 configured to engage the projectile 60 with the casing 40 and the flight control surface 70, 82, 84, or 86 includes a plurality of symmetrical fins longitudinally intermediate the neck and the front end 90 of the projectile. Alternatively, the casing 40 includes the neck 42 configured to couple the projectile 60 to the casing 40 and the flight control surface 70, 82, 84, or 86 includes a plurality of symmetrical fins longitudinally intermediate the neck and the rear end 124 of the projectile. It is contemplated the flight control surface 70, 82, 84, or 86 is integral to the projectile 60. In a further configuration, the flight control surface 70, 82, 84, or 86 is separable from the projectile 60. The cartridge can include a filler affixed to the projectile 60 adjacent the flight control surface 70, 82, 84, or 86. In one configuration, the flight control surface 70, 82, 84, or 86 is moveable from a retracted to an extended position. It is contemplated that the flight control surface 70, 82, 84, or 86 can be configured to generate lift on the projectile 60. In addition, the casing 40 can include an accommodating surface 32, 34 for the flight control surface 70, 82, 84, or 86. Thus, in one configuration, the flight control surface is a groove in an exterior surface of the projectile 60. In the cartridge, the projectile 60 includes a central body 80 connected to the radially projecting flight control surface, the central body having a maximum body dimension transverse to the longitudinal dimension, and wherein the radially projecting flight control surface 70, 82, 84, or 86 defines a maximum fin dimension transverse to the longitudinal dimension, the maximum radial dimension of the flight control surface being greater than the maximum body dimension.

The present disclosure provides a sabot-free cartridge 10 having a casing 40 and a projectile 60, wherein the projectile is partially retained within the casing and includes a plurality of radially projecting fins, either on the body portion, the tail portion, or both extending parallel to the longitudinal axis of the projectile. By sabot free, the present disclosure encompasses the cartridge 10 being without any device which ensures the correct positioning of the projectile in the barrel of a gun, wherein the device is attached either to the projectile or the inside the barrel and travels through the barrel to falling away from the projectile as the projectile leaves the muzzle. Thus, the present disclosure includes a sabot free barrel 30, wherein a projectile 60 having a plurality of radially projecting fins, either on the body portion, the tail portion, or both extending parallel to the longitudinal axis of the projectile, wherein a multitude of projectiles can be sequentially launched from the barrel.

The present disclosure further contemplates a projectile launcher having the projectile 60 coupled to the casing 40, the projectile having a front end 90 and a rear end 124 with a longitudinal axis extending from the front end to the rear end and at least one radially extending flight control surface 70, 82, 84, or 86; and the barrel 30 having an elongate bore 33 extending along the longitudinal axis, the elongate bore having a cross sectional profile configured to accommodate the radially extending flight control surface and form a bearing surface with the bore configured to prevent the passage of propellant gas (or generally function as a gas check), wherein the a cross sectional profile of the bore 33 is free of helical features contacting the projectile. With respect to the projectile launcher, the radially extending flight control surface 70, 82, 84, or 86 can be a fin having a leading edge 136.

As set forth above and seen in FIGS. 72-77, the magazine assembly is provided having housing sized to retain a plurality of cartridges, each cartridge having a longitudinal axis, the housing having a presenting end and a distal end; a follower disposed within the housing; and a bias member disposed intermediate the follower and the housing, the bias member configured to urge the follower towards the presenting end, the follower including a groove extending along the longitudinal axis of the cartridge, the groove sized to at least partly receive a portion of a radially projecting flight control surface of one of the plurality of cartridges.

In addition, the projectile can be a composite projectile assembly including an elongate body having a longitudinal axis extending between a leading end and a trailing end, the elongate body including a plurality of fins 70, 82, 84, or 86 extending parallel to the longitudinal axis, wherein the elongate body includes a core 62 of a first material and a cladding 64 of a different second material. In one configuration, the cladding 64 forms the plurality of fins. It is contemplated the core 62 is denser than the cladding 64.

The present disclosure includes the cartridge 10 for launching the projectile 60 through the barrel 30 including the casing 40, the projectile coupled to the casing to define a charge volume, the projectile extending along a longitudinal direction; a solid propellant retained within the charge volume; and the cradle 200 extending about at least a portion of a periphery of the projectile, the cradle being radially intermediate the casing and the projectile and configured to preclude passage of the cradle through the barrel. In one configuration, the cradle 200 includes a plurality of fingers 212. The cradle 200 can be configured to inhibit separation from the casing 40.

Alternatively, the projectile launching assembly for launching the projectile 60 having longitudinally extending flight control surfaces 70, 82, 84, or 86 by an expanding gas, includes the barrel 30 having the elongate bore 33, the bore having a cross section to pass the projectile, wherein the bore includes gas directing surfaces configured to impact a portion of the expanding gas. In this configuration, the directing surfaces are configured to impart a rotation of the projectile 60 about the longitudinal axis. Alternatively, in this configuration, the directing surfaces are configured to stabilize a trajectory of the projectile 60 about the longitudinal axis.

The projectile launcher kit can include the receiver; the barrel 30 connected to the receiver, the barrel having an elongate bore 33 extending along the longitudinal axis; and the plurality of muzzle brakes, each muzzle brake configured to operably couple with the barrel, the plurality of muzzle brakes including a first muzzle brake having a first twist rate and a second muzzle brake having a different second twist rate. In this kit, the cartridge 10 includes the casing 40 and the projectile 60 coupled to the casing, the projectile having the front end 90 and the rear end 124 with a longitudinal axis extending from the front end to the rear end and a radially projecting longitudinally extending flight control surface 70, 82, 84, or 86. The elongate bore has a cross sectional profile configured to accommodate the radially projecting longitudinally extending flight control surface 70, 82, 84, or 86 and form a bearing surface precluding the passage of propellant.

It is believed a cartridge 10 employing the projectile 60 requires less propellant (powder) than prior art projectiles, while still providing the same stopping capacity or range. This allows the cartridges 10 employing the present projectiles 60 to be lighter, thereby improving economics of manufacture as well as transportation of the cartridges 10. For example, in the configuration of the body portion 80 having the body portion fins 82, the amount of material used to the form such body portion is less than the body portion having the circumferential recess 99.

It is further contemplated that the tail portion 120 can be replaced by an extended length of the stem 160, wherein the extended length of the stem is sufficient to generate a stability margin sufficient to impart external ballistic stability. In one configuration, the extended stem can be an elongate flexible member which can be disposed between a retracted (or coiled) state and an extended (or uncoiled) state.

The present disclosure provides the projectile 60 configured to launch through the barrel 30 having the bore 33 extending along the longitudinal axis, the projectile including the first longitudinal segment, the second longitudinal segment, and the third longitudinal segment, wherein at least 50% of a cross sectional area in the first longitudinal segment comprises a first material, wherein at least 50% of a cross sectional area in the second longitudinal segment comprises a second material, and at least 50% of a cross sectional area in the third longitudinal segment comprises a third material. In one configuration, the first longitudinal segment is the nose section 96 of the body portion 80, the second longitudinal segment is the back section 98 of the body portion, and the third longitudinal section is one of the stem 160 and the tail portion 120. In a further configuration, the first longitudinal segment is the nose section 96 of the body portion 80, wherein the nose section can be formed of tungsten, the second longitudinal segment is the back section 98 of the body portion 80 and the back section can be formed of copper, and the third longitudinal section is one of the stem 160 and the tail portion 120 and the one of the stem and the tail portion can be formed of a polymer. Alternatively stated, at least one of the first longitudinal segment and the second longitudinal segment is formed of metal and the third longitudinal segment is a polymeric material, such as but not limited to thermoplastic, such as nylon, thermoplastic elastomer, thermoplastic vulcanizate, or thermoset. It is further contemplated the first longitudinal segment is denser than the second longitudinal segment, and the second longitudinal segment is denser that the third longitudinal segment. It is understood the body portion 80 can include radially projecting fins 82.

The disclosure further provides the projectile 60 including the body portion 80 configured to pass through the bore 33 of the barrel 30, the body portion 80 including a sealed balancing cavity 83; and the liquid 85 in the sealed balancing cavity.

Alternatively, the projectile 10 can include the body portion 80 configured to pass through the bore 33 of the barrel 30, wherein the body portion defines the internal balancing cavity 83; and the solid weight disposed within the balancing cavity, the solid weight moveable between the first position within the balancing cavity and the second position within the balancing cavity. It is understood the solid weight can be configured to move from the first position to the second position in response to gravity.

The barrel assembly of the present disclosure can include the elongate inner sleeve 310 extending along the longitudinal axis, the inner sleeve having the interior surface 311 defining the bore 33 having the radially inward projecting guide surface 32 extending along the longitudinal axis and an exterior surface 313 defining the periphery of the sleeve and the barrel body 330 disposed about the periphery of the inner sleeve. In one configuration, the barrel body 330 is a solid. In a further configuration, the barrel body 330 is an integral one piece construction. A further configuration provides the barrel body 330 is homogeneous.

The disclosure provides the method of forming the barrel assembly, including the steps of shaping, such as by extruding, the inner sleeve 310 having the interior surface 311 defining the bore 33 having the radially inward projecting guide surface 32 extending along the longitudinal axis and the exterior surface 313 defining the periphery of the inner sleeve; and embedding the periphery of the inner sleeve in the barrel body 330.

The present disclosure provides the projectile 60, wherein the projectile is asymmetrically weighted and having the elongate body portion 80 extending along the longitudinal axis, the body portion 80 having the cross sectional area perpendicular to the longitudinal axis, wherein the cross sectional area is asymmetric relative to the longitudinal axis. Alternatively, the disclosure provides the projectile 60 having the elongate body portion 80 extending along the longitudinal axis, the body having the cross sectional area perpendicular to the longitudinal axis, wherein the mass distribution of the cross sectional area is asymmetric relative to the longitudinal axis. The projectile 60 is further provided including the elongate body portion 80 extending along a longitudinal axis, the body having a cross sectional area perpendicular to the longitudinal axis, wherein at least one of the mass distribution and the cross sectional area is asymmetric relative to the longitudinal axis and configured to impart a preferential orientation relative to gravity. The projectile 60 can include fins 82, 130 configured to create lift relative to the preferential orientation.

As disclosed wherein, the cartridge 10 can include the casing 40 and the projectile 60 extending along the longitudinal axis and engaged with the casing, wherein the casing and the projectile define a charge volume retaining the charge, the projectile having a leading surface 61 and the trailing surface 63, and a passage 65 extending from the leading surface to the trailing surface. In one configuration, the passage 65 is coaxial with the longitudinal axis. In a further configuration the passage 65 is parallel to the longitudinal axis. A further configuration can include the first passage and the second passage 65. The projectile 60 of the cartridge 10 can include the temporary packing 68 at least partly occluding the passage 65. In the projectile 60 of the cartridge 10 the passage 65 can include the throat, wherein the throat can be longitudinally intermediate the leading surface 61 and the trailing surface 63.

The present firearm can include the barrel 30 having the bore 33 extending along the longitudinal axis, the bore having the cross sectional profile including the radially inward projecting guide surface 32 extending parallel to the longitudinal axis. In one configuration, the radially inward projecting guide surface 32 has a radial dimension of at least 10% the diameter of the bore 33. The disclosure further includes the projectile 60 having the first cross section and the longitudinally spaced second cross section, the first cross section configured to form the bearing surface with the bore 33 to provide the gas check with a portion of the inward projecting guide surface 32 and the second cross section configured to form the gas passage with the bore. A specific configuration provides the radially inward projecting guide surface 32 includes the inner apex, wherein the inner apex is configured to contact the projectile.

The disclosure also includes the firearm assembly for launching the projectile 60, the firearm assembly including the barrel 30 having the bore 33 extending along the longitudinal axis, the bore having the cross sectional profile including the radially inward projecting guide surface 32 extending parallel to the longitudinal axis and the outer bore surface 34, the outer bore surface 34 forming the bearing surface with the first portion of the projectile 60 at the first longitudinal position along the longitudinal axis and the outer bore surface being radially spaced from the projectile at the second position along the longitudinal axis.

The firearm assembly of the disclosure for launching the projectile 60 includes the barrel 60 extending along the longitudinal axis, the barrel including the bore 33 extending along the longitudinal axis between the breech 35 and the muzzle 36, the bore having the inner bore surface 32 and the outer bore surface 34, each of the inner bore surface and the outer bore surface extending parallel to the longitudinal axis, wherein at the first longitudinal position along the longitudinal axis the inner bore surface and the outer bore surface define respective first radial spacing and second radial spacing from the longitudinal axis and at the second longitudinal position along the longitudinal axis the inner bore surface is at the first radial spacing and the outer bore surface is at the third greater radial spacing from the longitudinal axis.

The present disclosure include the firearm assembly for launching the projectile 60, the firearm assembly including the barrel 30 extending along the longitudinal axis, the barrel including the bore 33 extending along the longitudinal axis between the breech 35 and the muzzle 36, the bore having the inner bore surface 32 and the outer bore surface 34 extending parallel to the longitudinal axis, wherein at the first longitudinal position the inner bore surface and the outer bore surface each define the bearing surface with the projectile, such as the gas check with the projectile, and at the second longitudinal position, the outer bore surface has the radial dimension configured to permit the passage of the propellant gas between the outer bore surface and the projectile.

The barrel assembly for the firearm of the present disclosure includes the elongate barrel 30 extending along the longitudinal axis, the barrel having the bore 33 extending along the longitudinal axis, the bore having the inner bore surface 32 and the outer bore surface 34 extending parallel to the longitudinal axis, wherein the inner bore surface is the first radial spacing from the longitudinal axis and the outer bore surface is the greater second radial spacing from the longitudinal axis.

The disclosure provides the projectile 60 for passing through the barrel 30 having the bore 33, the projectile including the elongate body 80 extending along the longitudinal axis; and the plurality of radially extending tail fins 130 connected to the body, each tail fin 130 defining the cross sectional profile perpendicular to the longitudinal axis, wherein the cross sectional profile includes the bypass channel 131 configured to pass the propellant gas from the rear of the tail fin to the front of the tail fin. The bypass channel 131 can be the groove in the exterior surface of the tail fin. In one configuration, the portion of the cross sectional profile of the tail fin forms the bearing surface with the bore of the barrel, thereby forming the gas check with the bore. In a further configuration, the elongate body 80 has the front end and the rear end with bearing surface being the periphery intermediate the front end and the rear end, wherein the bypass channels 131 are longitudinally intermediate the rear end and the bearing surface periphery.

The disclosure provides the barrel assembly including the elongate barrel having the longitudinal axis extending between the breech 35 and the muzzle 36, the barrel including the bore 33 extending along the longitudinal axis, the barrel having the cross sectional profile perpendicular to the longitudinal axis, the cross sectional profile including the contiguous portion, wherein the contiguous portion includes the cross section of the gas duct 340, wherein the gas duct extends along the contiguous portion of the body and fluidly communicates with the bore 33 intermediate the breech 35 and the muzzle 36 of the barrel.

The disclosure also provides a set of cartridges 10 for the firearm having the barrel 30 extending along the longitudinal axis, the barrel including the given caliber bore 33 extending along the longitudinal axis, the set of cartridges including each cartridge in the set of cartridges extending along the longitudinal axis and having the given caliber and including the projectile 60 and the casing 40, wherein (i) the first subset of the set of cartridges includes cartridges having projectiles of the first nominal diameter transverse to the longitudinal axis and the first visual indicator 72; and (ii) the second subset of the set of cartridges includes cartridges having projectiles of the second nominal diameter transverse to the longitudinal axis and the second visual indicator 72, the second nominal diameter being greater than the first nominal diameter and the second visual indicator being different from the first visual indicator.

Also disclosed is the barrel assembly for the firearm having the receiver, the barrel assembly including the barrel extending along the longitudinal axis LA, the barrel 30 configured to operatively engage the receiver, the barrel having the receiver end and the muzzle, the first barrel segment including the bore 33 extending along the longitudinal axis from the receiver end to the muzzle, the bore 33 having the muzzle end cross section perpendicular to the longitudinal axis, the bore including the radially inward projecting guide surface 32 extending parallel to the longitudinal axis; and the second barrel segment 12 having the coupling end and the second muzzle, the coupling end configured to engage the barrel, the second bore extending along the longitudinal axis, the second bore including the second radially inward projecting guide surface 32 extending parallel to the longitudinal axis, wherein the radially inward projecting guide surface and the second radially inward projecting guide surface are colinear.

This disclosure has been described in detail with particular reference to an embodiment, but it will be understood that variations and modifications can be effected within the spirit and scope of the disclosure. The presently disclosed embodiments are therefore considered in all respects to be illustrative and not restrictive. The scope of the invention is indicated by the appended claims, and all changes that come within the meaning and range of equivalents thereof are intended to be embraced therein

The invention claimed is:

1. A cartridge for a firearm, the cartridge comprising:

(a) a projectile having an elongate body portion extending along a longitudinal axis, the elongate body portion having a transverse dimension configured to engage the bore, the elongate body portion including a balancing cavity having a weight disposed within the balancing cavity, wherein the weight is (i) retained within the balancing cavity and (ii) movable within the balancing cavity between a first position and a second position in response to gravity;

(b) a tail portion defining a rear end of the projectile and including a plurality of radially extending tail fins, each of the radially extending tail fins having a leading edge longitudinally intermediate the elongate body portion and the rear end of the projectile;

(c) a stem connecting the elongate body portion and the tail portion; and (d) a casing coupled to the projectile, wherein at least a portion of the tail fins are disposed within the casing;

wherein the body portion, the tail portion, and the stem are colinearly disposed along a longitudinal axis and define a projectile center of pressure and a projectile center of mass, the projectile center of pressure being longitudinally intermediate the rear end of the projectile and the projectile center of mass.

2. The cartridge of claim 1, wherein the casing in conjunction with the projectile defining a charge volume and wherein a mass of propellant charge is disposed in the charge volume.

3. The cartridge of claim 1, wherein the elongate body portion includes plurality of radially extending body portion fins.

4. The cartridge of claim 1, wherein the elongate body portion has a first density and the tail portion has second density, the second density being lower than first density.

5. The cartridge of claim 1, wherein a length of the elongate body portion is greater than a combined length of the stem and the tail portion.

6. The cartridge of claim 1, wherein tail fins have a radial dimension less than the transverse dimension and the stem has a radial dimension less than the radial dimension of the tail fins.

7. The cartridge of claim 1, wherein the leading edge of the tail fins defines an increasing radial dimension toward the rear end along the longitudinal axis.

8. The cartridge of claim 1, wherein the elongate body portion has a non-homogenous density.

9. The cartridge of claim 1, wherein the elongate body portion includes a first component having a third density and the second component having a fourth density, each of the third density and the fourth density being different from the first density.

10. The cartridge of claim 1, wherein the balancing cavity and the weight define an ullage space.

11. The cartridge of claim 1, wherein the balancing cavity extends along the longitudinal axis within the elongate body portion.

12. The cartridge of claim 1, wherein the transverse dimension is a diameter of the elongate body portion.

13. The cartridge of claim 1, wherein the weight in the balancing cavity includes a liquid.

14. A projectile for passing through a bore of a barrel of a firearm, the bore having a bore caliber, the projectile comprising:

(a) an elongate body portion having a body radial dimension and a first density, wherein the body radial dimension is the bore caliber;

(b) a tail portion defining a rear end of the projectile and including a plurality of radially extending tail fins, the radially extending tail fins each having a leading edge longitudinally intermediate the body portion and the rear end of the projectile and a trailing edge longitudinally rearward of the leading edge; and (c) a stem connecting the body portion and the tail portion, wherein the stem has a stem diameter less than the body diameter;

wherein the body portion, the tail portion, and the stem are colinearly disposed along a longitudinal axis and define a projectile center of pressure and a projectile center of mass, wherein at least one of the radially extending tail fins defines a cross sectional profile perpendicular to the longitudinal axis, wherein the cross sectional profile defines a bypass channel configured to pass a propellant gas within the bore from the trailing edge of the tail fin to longitudinally forward of the leading edge of the tail fin.

15. The projectile of claim 14, wherein the leading edge each tail fin has a smaller cross-sectional area than a cross sectional area of the trailing edge of the tail fin.

16. The projectile of claim 14, further comprising (i) a casing connected to the projectile and in conjunction with the projectile defining a charge volume and (ii) a mass of propellant charge disposed in the charge volume.

17. A set of cartridges for operatively passing from a firearm, wherein each cartridge includes a projectile for passing through a bore of a barrel of the firearm, the bore having a bore caliber, the set of cartridges comprising:

(i) a first subset of cartridges and a second subset of cartridges, wherein each cartridge of the first subset and each cartridge of the second subset includes a respective (a) projectile having an elongate body portion extending along a longitudinal axis, the elongate body portion having a transverse dimension perpendicular to the longitudinal axis, the transverse dimension sized to contact the bore; (b) a tail portion defining a rear end of the projectile and including a plurality of radially extending tail fins; and (c) a casing coupled to the projectile, wherein at least a portion of the tail fins is disposed within the casing;

wherein the first subset of cartridges includes a first visual indicator.

18. The set of cartridges of claim 17, wherein a nominal transverse dimension of the elongate body portion of the first subset of cartridges is different from a nominal transverse dimension of the elongate body portion of the second subset of cartridges.

19. The set of cartridges of claim 17, wherein the first visual indicator is formed on one of the casing and the projectile of the first subset of cartridges.

20. The set of cartridges of claim 17, wherein the tail fins of the first subset of cartridges and the second subset of cartridges are sized to preclude contact with the bore.

* * * * *